US011158165B2

(12) United States Patent
Ito et al.

(10) Patent No.: US 11,158,165 B2
(45) **Date of Patent: *Oct. 26, 2021**

(54) NON-TRANSITORY STORAGE MEDIUM HAVING STORED THEREIN INFORMATION PROCESSING PROGRAM, INFORMATION PROCESSING APPARATUS, INFORMATION PROCESSING SYSTEM, AND INFORMATION PROCESSING METHOD

(71) Applicant: NINTENDO CO., LTD., Kyoto (JP)

(72) Inventors: Norihito Ito, Kyoto (JP); Hirokazu Matsuura, Kyoto (JP); Yugo Hayashi, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/851,502

(22) Filed: Apr. 17, 2020

(65) Prior Publication Data

US 2020/0242891 A1 Jul. 30, 2020

Related U.S. Application Data

(63) Continuation of application No. 16/034,407, filed on Jul. 13, 2018, now Pat. No. 10,665,058.

(30) Foreign Application Priority Data

Aug. 1, 2017 (JP) ..... JP2017-148930

(51) Int. Cl.
*G07F 17/32* (2006.01)

(52) U.S. Cl.
CPC ..... *G07F 17/3262* (2013.01); *G07F 17/3209* (2013.01); *G07F 17/3211* (2013.01); *G07F 17/3246* (2013.01); *G07F 17/3248* (2013.01)

(58) Field of Classification Search
USPC ..... 463/22, 13, 17
See application file for complete search history.

(56) References Cited

U.S. PATENT DOCUMENTS 9,922,498 B2 * 3/2018 Fine ..... A63F 13/00
10,665,058 B2 * 5/2020 Ito ..... G07F 17/3209
(Continued)

FOREIGN PATENT DOCUMENTS

JP 2017-35236 2/2016
JP 2017-10335 1/2017

OTHER PUBLICATIONS

DX Girolamo, Osu Bancho2 OraOra-Rendering, YouTube [online][video], Jun. 28, 2013, searched on Apr. 18, 2019, URL https://youtube.com/watch?v=HZxoV1NWNbY.

(Continued)

*Primary Examiner* — Pierre E Elisca
(74) *Attorney, Agent, or Firm* — Nixon & Vanderhye P.C.

(57) ABSTRACT

After a game is performed, a lottery process for selecting any content from among a plurality of contents by lot is executed. In accordance with the degree of rarity of the content selected by lot in the lottery process, the number of times of an operation to be performed by a user is set. Before a lottery result is displayed, lottery representation is performed, and in the lottery representation, a user is caused to perform the operation. In accordance with the fact that the number of times of the operation performed by the user reaches the set number of times of the operation, the lottery result is displayed on a display section. When the number of times of the operation performed by the user does not reach the set number of times of the operation, representation is changed in accordance with the user operation.

20 Claims, 10 Drawing Sheets

(56) References Cited

U.S. PATENT DOCUMENTS

| | | | | |
|---|---|---|---|---|
| 10,762,716 | B1 * | 9/2020 | Paul | G06F 3/04842 |
| 2006/0040735 | A1 * | 2/2006 | Baerlocher | G07F 17/3244 463/26 |
| 2010/0222124 | A1 * | 9/2010 | Goshen | G07F 17/3295 463/16 |
| 2012/0081267 | A1 * | 4/2012 | Sirpal | G06F 3/04845 345/1.1 |
| 2012/0115581 | A1 * | 5/2012 | Englman | G07F 17/3258 463/25 |
| 2015/0149936 | A1 * | 5/2015 | Sirpal | G06F 3/0488 715/761 |
| 2017/0076540 | A1 * | 3/2017 | Saffari | G07F 17/329 |
| 2017/0098346 | A1 * | 4/2017 | Fine | G07F 17/3241 |
| 2017/0250006 | A1 * | 8/2017 | Ovalle | H01B 1/02 |
| 2017/0287592 | A1 * | 10/2017 | Ovalle | G07F 17/3204 |
| 2018/0096752 | A1 * | 4/2018 | Ovalle | H04W 4/60 |
| 2019/0310763 | A1 * | 10/2019 | Sirpal | G06F 3/0416 |

OTHER PUBLICATIONS

[MonBea] Defining rendering of winning Gacha on Monster Beat?, Game with SmartPhone!, Oct. 21, 2015, [online] searched on Apr. 18, 2019, URL http://appgames55.blog.fc2.com/blog-entry-47.htm1.

Notice of Reasons for Refusal dated Sep. 12, 2019 in Japanese Patent Application No. 2017-148930, eight pages, with machine translation.

Office Action dated Apr. 25, 2019 issued in Japanese Application No. 2017-148930 (3 pgs.).

Osu! Bancho 2, Pachi Slot Winning Guide MAX, Japan, Byakuya Shobo, Apr. 1, 2012, vol. 15 No. 7, p. 9 (5 pgs.).

Rupan Sansei—Deleted Rupan, Pachinko pseudo continuation notice, Pachist PGQ [online], Feb. 4, 2016, searched on Sep. 5, 2019 URL, https://pachist.jp/pachi/205/5248/, four pages, (No translation available).

Which Gacha Rendering is easier to win SSR of Gang Road Joker?, Walk-Through Site for Gang Road Joker—Tips of Gang Road—[online], Mar. 20, 2014, searched on Apr. 18, 2019, URL http://grjoker.com/syosinsya/gatyakitaido/.

How is the determination presentation of Dokkan Battle Gacha like?, Information Bureau to get billing items cheap, Mar. 10, 2017, [online], [searched on Apr. 6, 2021], <https://xn--mck3at8ila7ae.net/%E3%83%89%E3%83%83%E3%82%AB%E3%83%B3%E3%83%90%E3%83%88%E3%83%AB%E3%82%AC%E3%83%81%E3%83%A3%E7%A2%BA%E5%AE%9A%E6%BC%94%E5%87%BA.html>.

Notice of Reasons for Refusal dated Apr. 15, 2021 in Japanese Patent Application No. 2020-085105 with English machine translation.

* cited by examiner

FIG. 5

LOTTERY PROBABILITY WHEN GAME IS CLEARED

| CONTENT | LOTTERY PROBABILITY (%) | DEGREE OF RARITY |
|---|---|---|
| C10 | 38 | 1 |
| C20 | 30 | 2 |
| C30 | 18 | 3 |
| C40 | 10 | 4 |
| C50 | 4 | 5 |
| C60 | 0 | 6 |

FIG. 6

LOTTERY PROBABILITY WHEN SPECIAL ITEM IS CONSUMED

| CONTENT | LOTTERY PROBABILITY (%) | DEGREE OF RARITY |
|---|---|---|
| C10 | 0 | 1 |
| C20 | 0 | 2 |
| C30 | 42 | 3 |
| C40 | 38 | 4 |
| C50 | 15 | 5 |
| C60 | 5 | 6 |

FIG. 7

| DEGREE OF RARITY OF CONTENT | NUMBER OF TIMES OF OPERATION TO BE SET |
|---|---|
| 1 | 1 |
| 2 | 2 |
| 3 | 3 |
| 4 | 4 |
| 5 | 5 |
| 6 | 6 |

NON-TRANSITORY STORAGE MEDIUM HAVING STORED THEREIN INFORMATION PROCESSING PROGRAM, INFORMATION PROCESSING APPARATUS, INFORMATION PROCESSING SYSTEM, AND INFORMATION PROCESSING METHOD

CROSS REFERENCE TO RELATED APPLICATION

This application is a continuation of U.S. application Ser. No. 16/034,407, filed Jul. 13, 2018, now allowed; and claims priority to Japanese Patent Application No. 2017-148930, filed on Aug. 1, 2017; the entire contents of each being incorporated herein by reference.

FIELD

An exemplary embodiment relates to an information processing program, an information processing apparatus, an information processing system, and an information processing method for displaying a lottery result.

BACKGROUND AND SUMMARY

Conventionally, there is an apparatus for giving, for example, a character or an item to be used in a game to a user by a lottery. In such an apparatus, when a lottery is held, the lottery result is displayed on a screen.

In the conventional technique, however, a content selected by lot is merely displayed on a display screen, and there is room for improvement in increasing the user's sense of anticipation for a lottery result.

Therefore, it is an object of an exemplary embodiment to provide an information processing program, an information processing apparatus, an information processing system, and an information processing method that are capable of increasing the user's sense of anticipation for a lottery result.

To achieve the above object, the exemplary embodiment employs the following configurations.

An exemplary embodiment is a non-transitory storage medium having stored therein an information processing program executed by a computer of an information processing apparatus, the information processing program causing the computer to execute: acquiring a lottery result of a lottery process for, based on a certain probability, selecting by lot at least one content to be given to a user from among a plurality of contents; acquiring a user operation performed by a user; setting a determination condition regarding the user operation so that the determination condition differs in accordance with the lottery result; and displaying the lottery result on a display section in accordance with the fact that the user operation satisfying the set determination condition is performed.

Based on the above, until a lottery result is displayed, a user operation corresponding to the lottery result is necessary. Thus, it is possible to increase the user's sense of anticipation until the lottery result is displayed.

Further, in another configuration, the determination condition may be a condition regarding an amount of the user operation.

Based on the above, the amount of the user operation differs in accordance with the lottery result. Thus, a user performs operations different in amount until the lottery result is displayed. Thus, it is possible to increase the user's sense of anticipation with respect to each operation.

Further, in another configuration, in accordance with the fact that the user operation performed after a lottery process satisfies the determination condition, the lottery result may be displayed on the display section.

Based on the above, in accordance with the user operation performed after a lottery process is performed, it is possible to display the lottery result.

Further, in another configuration, the determination condition may be set so that the lower the lottery probability of a content selected by lot by the lottery process, the larger the amount of the user operation.

Based on the above, the higher the degree of rarity of a content selected by lot, the larger the amount of the user operation. Thus, it is possible to cause a user to perform an operation having a large amount of operation until the lottery result is displayed. For example, the higher the degree of rarity of the content, the greater the number of times of the operation of the user until the lottery result is displayed, or the longer the operation distance, or the longer the operation time. Consequently, when the user performs an operation next, the user can have anticipation and anxiety regarding whether or not the lottery result will be displayed. Thus, it is possible to improve interest.

Further, in another configuration, as the determination condition, a different number of times may be set in accordance with the lottery result. In accordance with the fact that the number of times of the user operation performed by the user reaches the set number of times, the lottery result may be displayed on the display section.

Based on the above, before the lottery result is displayed, a user is caused to perform an operation multiple times. Thus, it is possible to increase the user's sense of anticipation with respect to each operation.

Further, in another configuration, a setting may be made so that the lower the lottery probability of the content selected by lot by the lottery process, the greater the number of times.

Based on the above, the higher the degree of rarity of a content, the greater the number of times of the operation of the user until the lottery result is displayed.

Further, in another configuration, the user operation may be a touch operation, and a setting may be made so that an amount regarding the touch operation differs in accordance with the lottery result.

Based on the above, in accordance with the fact that the amount of a touch operation set in accordance with the lottery result is performed, it is possible to display the lottery result.

Further, in another configuration, the information processing program may further cause the computer to execute, before the lottery result is displayed on the display section, executing first representation that changes in accordance with an amount of the user operation performed by the user.

Based on the above, before the lottery result is displayed, and in accordance with the amount of the user operation, it is possible to change representation. For example, in accordance with the number of times of the user operation performed by a user, it is possible to change representation using an image, a sound, a vibration, or the like.

Further, in another configuration, an image may be displayed on the display section as the first representation, and in accordance with the amount of the user operation performed by the user, the image may be changed.

Based on the above, before the lottery result is displayed, and in accordance with the amount of the user operation, it is possible to change an image.

Further, in another configuration, the information processing program may further cause the computer to execute, before the lottery result is displayed on the display section and before the user operation is performed, executing second representation based on the lottery result.

Based on the above, before the user operation is performed, and based on the lottery result, it is possible to execute second representation. The amount of the user operation is set in accordance with the lottery result. Thus, the second representation can suggest the lottery result and also suggest the amount of an operation to be performed by a user from now. Thus, it is possible to cause the user to perform an operation to be performed by anticipating the operation.

Further, in another configuration, the information processing program further may cause the computer to execute: before the lottery process is performed, executing a game using a player object; and after the lottery process is performed and before the lottery result is displayed on the display section, executing third representation that causes the player object to perform an action based on the user operation performed by the user.

Based on the above, in third representation before the lottery result is displayed, it is possible to cause a player object used in a predetermined game to perform an action, and it is possible to display the lottery result as the result of the third representation. Thus, it is possible to associate the predetermined game with the third representation, and it is possible to improve the interest of the lottery while maintaining the world view of the game.

Further, in another configuration, in the game, the player object may perform an action on another object. As the third representation, display of the other object may be changed in accordance with the fact that the player object performs the action on the other object.

Based on the above, in the third representation, it is possible to achieve an action similar to the action of the player object performed in the predetermined game.

Further, another exemplary embodiment may be an information processing apparatus for executing the program. Further, another exemplary embodiment may be an information processing system including the above means. An information processing system may include one or more apparatuses. Further, another exemplary embodiment may be an information processing method performed by the information processing system.

According to the exemplary embodiment, it is possible to increase the user's sense of anticipation until a lottery result is displayed.

These and other objects, features, aspects and advantages of the exemplary embodiments will become more apparent from the following detailed description of the exemplary embodiments when taken in conjunction with the accompanying drawings.

BRIEF DESCRIPTION OF THE DRAWINGS

FIG. 5 is an example non-limiting diagram showing an example of a table for use in a content lottery executed after the user clears the predetermined game;

FIG. 6 is an example non-limiting diagram showing an example of a table for use in a content lottery executed by the user consuming a special item;

FIG. 7 is an example non-limiting diagram showing an example of the number of times of an operation set in accordance with the degree of rarity of a content selected by a content lottery;

DETAILED DESCRIPTION OF NON-LIMITING EXAMPLE EMBODIMENTS

Figure 1:
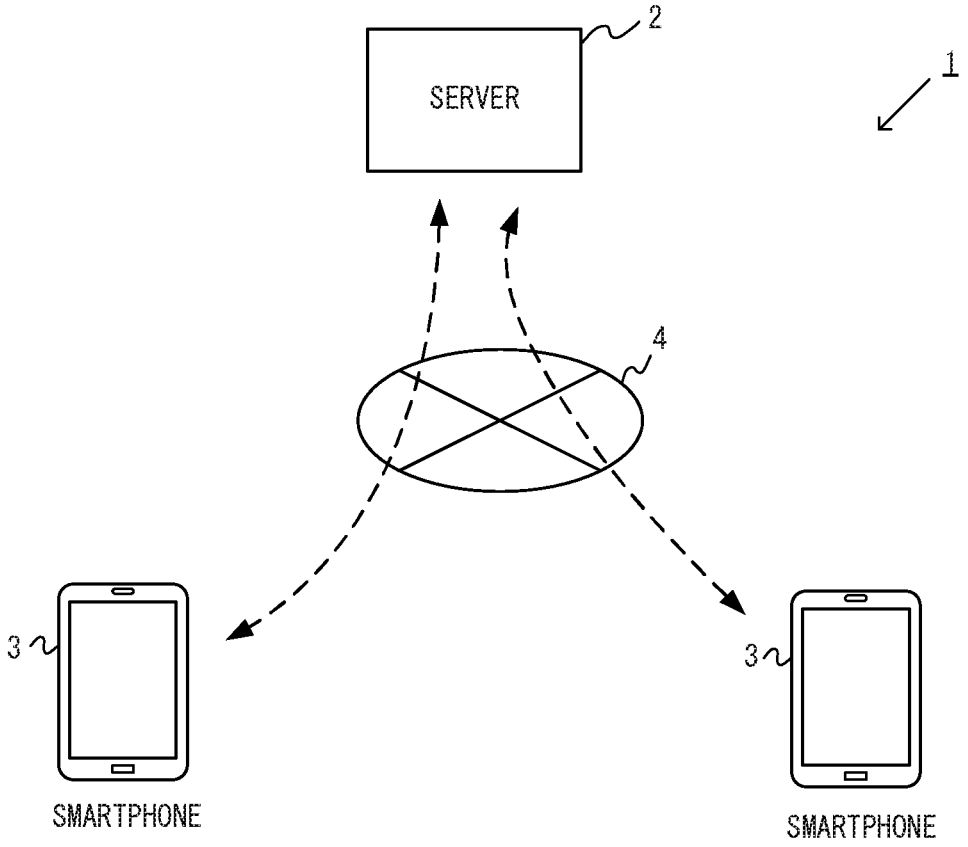
FIG. 1 is an example non-limiting diagram showing an example of the configuration of a game system 1 according to an exemplary embodiment.

With reference to the drawings, a description is given below of a game system according to an exemplary embodiment. FIG. 1 is a diagram showing an example of the configuration of a game system 1 according to the exemplary embodiment. As shown in FIG. 1, the game system 1 includes a server 2 and smartphones 3. The server 2 and the smartphones 3 are connected to the Internet 4.

The server 2 includes at least one CPU, a memory, a storage device such as a hard disk, and a communication apparatus and can execute a predetermined information processing program. The server 2 may include a plurality of server apparatuses, or may include a single server apparatus. The server 2 can communicate with the plurality of smartphones 3 via the Internet.

Each smartphone 3 is an example of an information processing apparatus. The smartphone 3 can execute a game application described later. The smartphone 3 can also execute various applications (e.g., a web browser, a mailer, another game application, and the like) in addition to the game application.

The smartphone 3 can connect to a mobile communication network (in other words, a mobile phone network) and can function as a mobile phone. Further, the smartphone 3 can also connect to a wireless LAN. The smartphone 3 is connected to the Internet via the mobile communication network and/or the wireless LAN.

(Example of Configuration of Smartphone)

Figure 2:
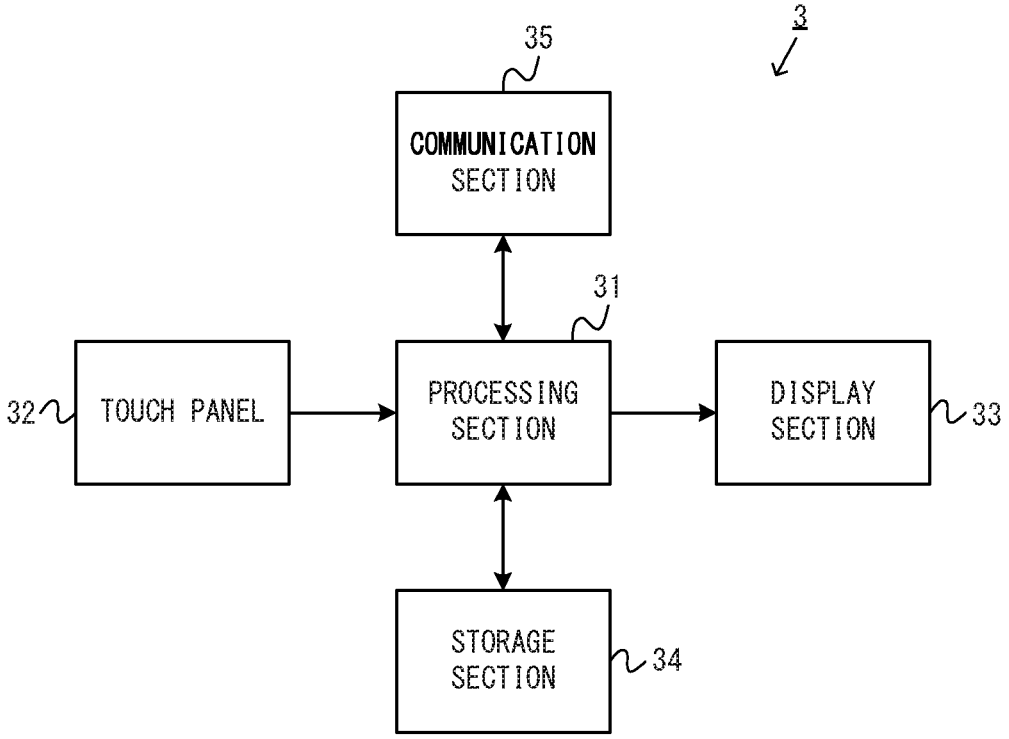
FIG. 2 is an example non-limiting block diagram showing an example of the configuration of a smartphone 3.

FIG. 2 is a block diagram showing an example of the configuration of the smartphone 3. As shown in FIG. 2, the smartphone 3 includes a processing section 31, a touch panel 32, a display section 33, a storage section 34, and a communication section 35.

The processing section 31 includes a CPU for executing a predetermined information processing program (the game application program described later, another application program, or the like), and a memory.

The touch panel 32 is provided on a screen of the display section 33. The touch panel 32 receives a touch operation performed on the screen by a user.

The display section 33 is a display device for displaying a letter and an image and is, for example, a liquid crystal display device or an organic EL display device. Further, the storage section 34 is a non-volatile memory, a hard disk, or the like. The storage section 34 stores the game application program described later.

The communication section 35 connects to the mobile communication network and/or the wireless LAN and communicates with the server 2.

It should be noted that the smartphone 3 also includes a speaker, a microphone, a camera, and the like in addition to the components shown in FIG. 2. Further, the smartphone 3 may include a button for receiving a user operation. Further, the smartphone 3 may include a direction indication key, an analog stick, and the like for receiving a user operation. Further, the smartphone 3 may include inertial sensors (an acceleration sensor, an angular velocity sensor, and the like) and a magnetic sensor for detecting the motion and the tilt of the smartphone 3 itself. Further, the smartphone 3 may include a vibration motor.

The user starts a game application in the smartphone 3 and executes a predetermined game. In the exemplary embodiment, when the predetermined game is executed, a lottery process for selecting any one of a plurality of contents by lot is performed, and the content selected by lot is given to the user. It should be noted that a plurality of contents may be given to the user by a single lottery.

Here, the content to be given to the user may be a character or an item (a weapon, a protective guard, a physical strength recovery item, an item for favorably advancing the game, an item essential for advancing the game, money in the game, a coin, or the like) to be used in the predetermined game. Further, the content to be given to the user may be an additional game, an additional stage, a still image, a moving image, or a composition. Further, the content to be given to the user may be a character, an item, an additional game, an additional stage, a still image, a moving image, a composition, or the like to be used in another game other than the predetermined game. Further, the content to be given to the user may be data to be used in another application other than the game application.

Figure 3:
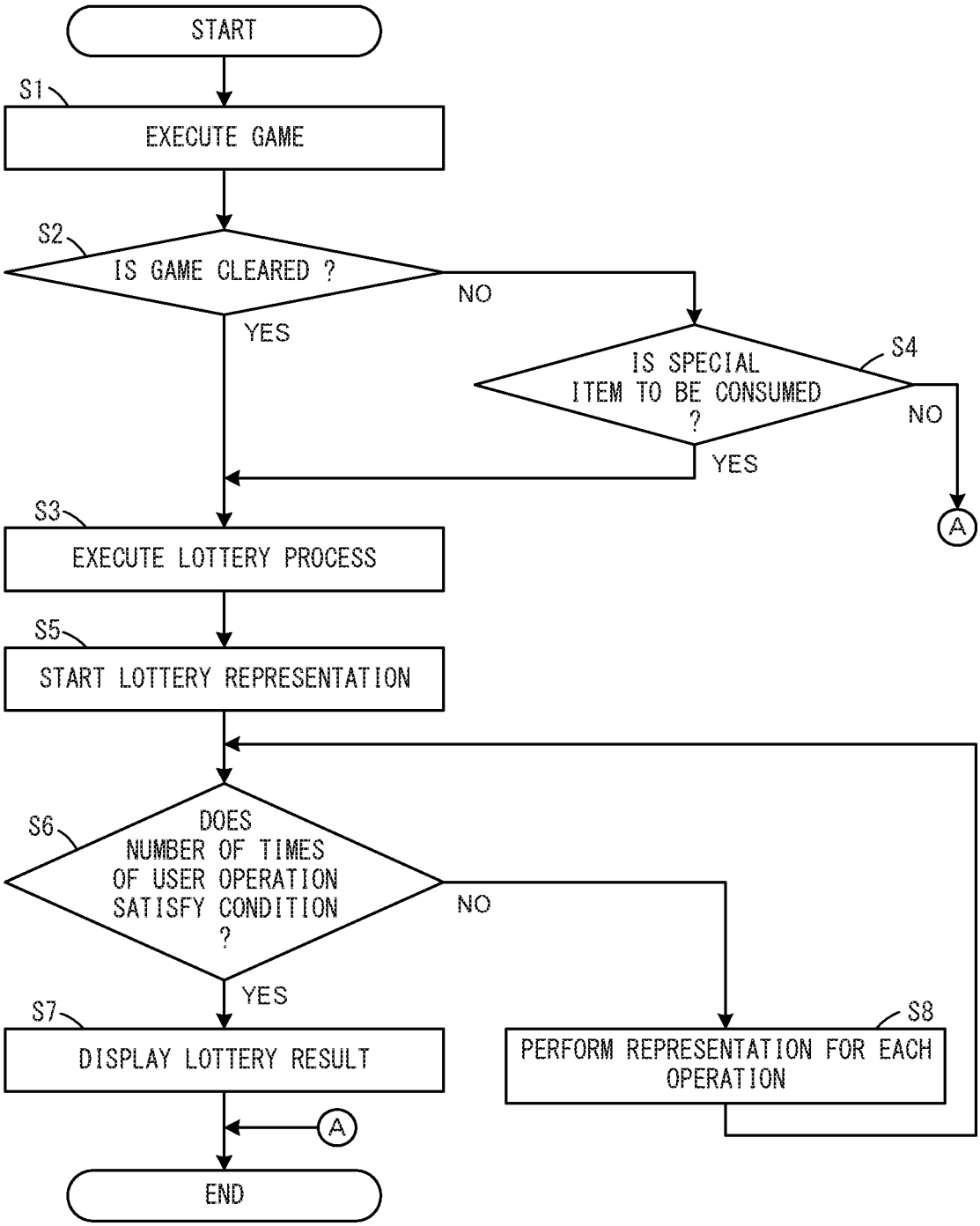
FIG. 3 is an example non-limiting diagram showing an example of the flow of processing until a content is given to a user.

With reference to FIGS. 3 to 7, a description is given below of an overview of processing until a content is given to the user by a lottery. FIG. 3 is a diagram showing an example of the flow of the processing until a content is given to the user. The processing shown in FIG. 3 is performed by the cooperation of the smartphone 3 and the server 2.

As shown in FIG. 3, first, a predetermined game is executed in the smartphone 3 (step S1). The predetermined game may be any game such as a fighting game, a shooting game, a puzzle game, a racing game, or a role-playing game. An example of the predetermined game is described below.

Figure 4:
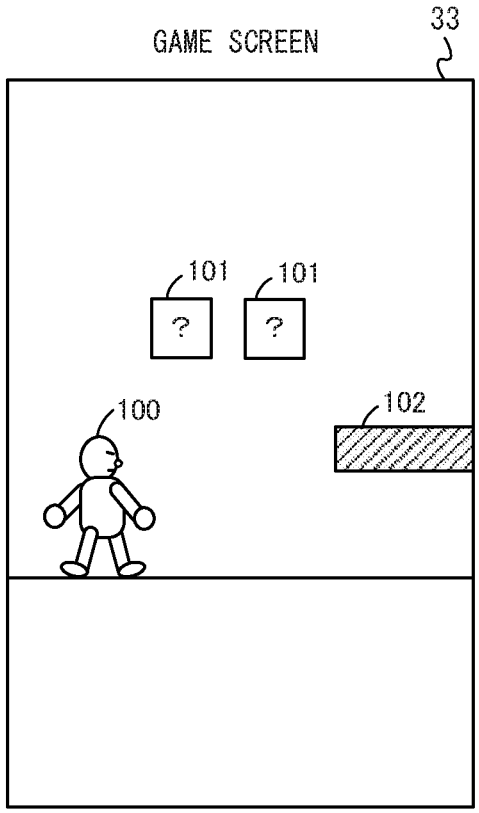
FIG. 4 is an example non-limiting diagram showing an example of a game screen of a predetermined game executed in step S1.

FIG. 4 is a diagram showing an example of a game screen of the predetermined game executed in step S1. The predetermined game includes one or more stages. As shown in FIG. 4, on the screen of the display section 33 of the smartphone 3, a player character 100, blocks 101, and a geographical object 102 are displayed. In addition to the character and the like shown in FIG. 4, an enemy character may also be displayed on the game screen. The user performs a touch operation on the touch panel 32, thereby operating the player character 100. In the exemplary embodiment, the player character 100 automatically moves in the right direction of the screen. Then, in accordance with a tap operation (the operation of touching the screen with a finger and immediately separating the finger from the screen) on the touch panel 32 by the user, the player character 100 jumps in a virtual space. When the player character 100 jumps in the virtual space and hits one of the blocks 101, an item appears from the block 101, and the player character 100 can acquire the item.

Further, when an enemy character appears on the screen, the user performs a tap operation to cause the player character 100 to jump, thereby preventing the player character 100 from colliding with the enemy character. When the player character 100 collides with an enemy character, this stage ends at the time of the collision. When the player character 100 reaches a goal provided in the right direction in the virtual space without colliding with an enemy character along the way, this stage is cleared.

It should be noted that the player character 100 may not automatically move in the right direction of the screen and may move in the right direction of the screen in accordance with a user operation. For example, in accordance with a slide operation (e.g., the operation of moving a finger while touching the screen with the finger) on the touch panel 32, the player character 100 may move in the slide direction. Further, when the smartphone 3 includes a button or a direction indication key, then in accordance with an operation on the button or the direction indication key, the player character 100 may move in the left-right direction or jump.

Referring back to FIG. 3, after the predetermined game is executed, it is determined whether or not the predetermined game is cleared (step S2). For example, when the user clears a single stage, it may be determined that the predetermined game is cleared. Alternatively, when the user clears a predetermined number of stages, it may be determined that the predetermined game is cleared. Yet alternatively, when a predetermined number of stages are executed, regardless of whether or not each stage is cleared, it may be determined that the predetermined game is cleared. Yet alternatively, when a predetermined time elapses from the start of the predetermined game, it may be determined that the predetermined game is cleared.

When the predetermined game is cleared (step S2: YES), a lottery process for selecting any content from among a plurality of contents by lot in accordance with a predetermined probability is executed (step S3). Further, even when the predetermined game is not cleared (step S2: NO), but when the user gives an instruction to consume a special item (step S4: YES), the lottery process is executed (step S3). The special item is, for example, an item that can be acquired by the user during the execution of the predetermined game. For example, the predetermined game may include a special stage, and the special item may be an item that can be acquired in the special stage. Alternatively, the special item may be an item that can be acquired in exchange for real money or money in the game by the user. When the lottery process in step S3 is performed, the result of the lottery is saved.

It should be noted that the process of selecting by lot any content from among the plurality of contents performed in step S3 is occasionally referred to as a "content lottery".

For each of the plurality of contents, a lottery probability is set in advance. In step S3, a lottery is held based on the lottery probabilities set in advance, whereby any one of the plurality of contents is selected.

FIG. 5 is a diagram showing an example of a table for use in the content lottery executed after the user clears the predetermined game. FIG. 6 is a diagram showing an example of a table for use in the content lottery executed by the user consuming a special item. In step S3, the content lottery is executed based on lottery probabilities stored in the table shown in FIG. 5 or 6.

As shown in FIGS. 5 and 6, contents C10, C20, C30, C40, C50, and C60 are prepared as the plurality of contents. As shown in FIG. 5, in the content lottery executed after the user clears the predetermined game, for example, the probability of the content C10 being selected is 38%, the probability of the content C20 being selected is 30%, the probability of the content C30 being selected is 18%, the probability of the content C40 being selected is 10%, and the probability of the content C50 being selected is 4%. In the content lottery executed after the user clears the predetermined game, the content C60 is not selected.

Each content is classified into a degree of rarity corresponding to its lottery probability. The content C10 is classified into a degree of rarity of "1", the content C20 is classified into a degree of rarity of "2", the content C30 is classified into a degree of rarity of "3", the content C40 is classified into a degree of rarity of "4", the content C50 is classified into a degree of rarity of "5", and the content C60 is classified into a degree of rarity of "6".

Further, as shown in FIG. 6, in the content lottery executed by the user consuming a special item, the probabilities of the contents C10 and C20 being selected are 0%, the probability of the content C30 being selected is 42%, the probability of the content C40 being selected is 38%, the probability of the content C50 being selected is 15%, and the probability of the content C60 being selected is 5%.

It should be noted that each degree of rarity may include a plurality of types of contents. In this case, the lower the degree of rarity, the more contents may be included. For example, the content C10, which has a degree of rarity of "1", may include 100 contents, the content C30, which has a degree of rarity of "3", may include 50 contents, and the content C60, which has a degree of rarity of "6", may include three contents.

Here, a "degree of rarity" is a rarity degree or a rank set for each content, and does not necessarily correspond to an actual lottery probability. For example, in a case where there are two types of contents classified into a degree of rarity of "6", and there are ten types of contents classified into a degree of rarity of "5", and when a content having a degree of rarity of "6" is selected by lot with a probability of 5%, and a content having a degree of rarity of "5" is selected by lot with a probability of 15%, the lottery probability (e.g., 5%/2=2.5%) of a single content classified into a degree of rarity of "6" is higher than the lottery probability (e.g., 15%/10=1.5%) of a single content classified into a degree of rarity of "5".

It should be noted that a "degree of rarity" may be a lottery probability set for each content. That is, as shown in FIGS. 5 and 6, each content may not be classified as in a rarity degree or a rank, and only the lottery probability of the content may be set. In this case, the lottery probability and the degree of rarity correspond to each other. The lower the lottery probability of the content, the higher the degree of rarity of the content. The higher the lottery probability of the content, the lower the degree of rarity of the content.

When each degree of rarity includes a plurality of types of contents, a content may be selected by a single lottery as shown below, or a content may be selected by two lotteries.

For example, when a content is selected by a single lottery, a lottery probability is set for each content, and a lottery is held based on the set lottery probability. In this case, the total of the lottery probabilities set for the contents is 100%.

Further, when a content is selected by two lotteries, for example, a degree of rarity may be selected by a first lottery, and any content may be selected from among a plurality of types of contents classified into the selected degree of rarity by the second lottery. In this case, as shown in FIGS. 5 and 6, a lottery probability is set in advance for each degree of rarity, and the total of the lottery probabilities of the degrees of rarity is 100%. Further, a lottery probability is set for each of a plurality of types of contents included in the same degree of rarity, and the total of the lottery probabilities of the contents is 100%.

As is clear from comparison between FIGS. 5 and 6, it is more likely that a content having a high degree of rarity (i.e., a low lottery probability) is selected, when the user consumes a special item than when the user clears the predetermined game. Thus, the user can acquire a rarer content by consuming a special item and holding the content lottery. Thus, it is possible to provide the user with a motivation to collect a special item in the predetermined game. Further, lottery probabilities may be set so that even when the same type of content can be acquired by the user, it is more likely that a content having a high degree of rarity is selected, when the user consumes a special item than when the user clears the predetermined game. For example, in FIG. 5, a value greater than 0, such as "1%", may be set as the lottery probability of a degree of rarity of "6". Then, as shown in FIG. 6, "5%" may be set as the lottery probability of a degree of rarity of "6".

It should be noted that the user can execute the predetermined game multiple times, and can hold the content lottery multiple times. Further, the user can consume a special item multiple times and hold the content lottery multiple times. In a case where the content lottery is held multiple times, every time the content lottery is held, the content lottery may be held with the same probabilities. In this case, the same content as a content acquired by the user holding the content lottery in the past may be selected by lot. That is, in this case, the content lottery is held based on fixedly set lottery probabilities each time. Thus, the degree of expectation that each content will be selected does not change each time. Thus, in this case, no matter how many times the content lottery is held, the user may not be able to acquire a particular content.

Further, in a case where the content lottery is held multiple times, the lottery may be held so that a content other than a content already acquired by the user is selected. For example, when the content C10, which has a degree of rarity of "1", is selected with a probability of 38% in accordance with FIG. 5 in the first content lottery, then in the second content lottery, a content may be selected from among the plurality of contents except for the content C10, which is selected in the first content lottery. That is, a content acquired once by the content lottery may be removed from lottery targets of the content lottery next time and thereafter. In this case, the lottery probabilities of the contents in the content lottery change each time. If the lottery is continued, the user can certainly acquire all the types of contents. In this case, when the content lottery is held, the types of contents as the lottery targets, the lottery probabilities of the contents, the number of contents as the lottery targets, and the like in the current content lottery may be presented to the user. Then, when the rarest content is acquired, the above information may be reset to an initial state (i.e., a primary state before the lottery probabilities are changed). Alternatively, in accordance with a user operation, the above information may be reset to the initial state.

Further, in a case where the content lottery is held multiple times, and even when a content acquired by the content lottery is not removed from lottery targets, the lottery probabilities of the contents may change every time the content lottery is held. For example, in accordance with the previous lottery probabilities, the current lottery probabilities may change. For example, when a content having a degree of rarity of "1" is previously selected, then in the current content lottery, the lottery probability of a content having a degree of rarity of "1" may be set to be lower (or higher) than the previous lottery probability. Further, the lottery probabilities may change depending on the date and time when the content lottery is held.

Referring back to FIG. 3, after the lottery process is executed in step S3, lottery representation is started in the smartphone 3 (step S5). Here, the "lottery representation" is representation for displaying the lottery result of step S3 and is representation before the lottery result is displayed. The "lottery representation" is performed in steps S5 to S8.

After the lottery representation is started in step S5, a tap operation on the touch panel 32 by the user is detected, and it is determined whether or not the number of times of the tap operation performed by the user satisfies a determination condition (step S6). Here, the "determination condition" is set in accordance with the result of the lottery process in step S3. Specifically, in accordance with the degree of rarity of the content selected by lot by the lottery process, the number of times of the operation is set. Then, in step S6, it is determined whether or not the number of times of the tap operation performed by the user reaches the set number of times of the operation. The number of times of the operation set here is the number of times of a user operation necessary for the user to view the lottery result.

FIG. 7 is a diagram showing an example of the number of times of the operation to be set in accordance with the degree of rarity of the content selected by the content lottery. As shown in FIG. 7, when the degree of rarity of the content selected by the lottery process in step S3 is "1", "1" is set to the number of times of the operation. Further, when the degree of rarity of the selected content is "2", "2" is set to the number of times of the operation. When the degree of rarity of the selected content is "3", "3" is set to the number of times of the operation. When the degree of rarity of the selected content is "4", "4" is set to the number of times of the operation. When the degree of rarity of the selected content is "5", "5" is set to the number of times of the operation. When the degree of rarity of the selected content is "6", "6" is set to the number of times of the operation.

It should be noted that the degree of rarity of the content and the number of times of the operation to be set may not necessarily coincide with each other. For example, when the degree of rarity of the content is "1" or "2", "1" may be set to the number of times of the operation. When the degree of rarity of the content is "3" or "4", "2" may be set to the number of times of the operation. When the degree of rarity of the content is "5" or "6", "3" may be set to the number of times of the operation.

Further, in accordance with the degree of rarity of the selected content, the number of times of the operation to be set may be determined by a lottery. In this case, the lottery may be held so that the higher the degree of rarity of the selected content, the greater the number of times of the operation. For example, when the degree of rarity of the selected content is "1", the lottery may be held so that the probability of "1" being set to the number of times of the operation is highest. Further, for example, when the degree of rarity of the selected content is "2", the lottery may be held so that the probability of "2" being set to the number of times of the operation is highest.

Referring back to FIG. 3, when it is determined that the number of times of the tap performed by the user reaches the number of times of the operation set in accordance with the degree of rarity (step S6: YES), the lottery result is displayed (step S7). Specifically, an image of the content selected in step S3 and/or letters indicating the content name of the content selected in step S3 are displayed on the screen of the smartphone 3. When the lottery result is displayed in step S7, the processing shown in FIG. 3 ends.

On the other hand, when it is determined that the number of times of the tap operation performed by the user does not reach the set number of times of the operation (step S6: NO), representation corresponding to the performance of the tap operation is executed (step S8). For example, in accordance with the tap operation, a sound effect is output, or the screen is darkened (or brightened), or an image (an image of the block 101 described later in FIG. 8) is enlarged. After the process of step S8, the determination in step S6 is made again.

As described above, in a game according to the exemplary embodiment, a content to be given to the user is selected by lot from among a plurality of contents (a character, an item, an image, and the like) based on a predetermined probability (step S3), and in accordance with the lottery result, the number of times of the operation is set, and in accordance with the fact that a tap operation is performed the set number of times of the operation, the lottery result is displayed (step S7).

It should be noted that the user operation for displaying the lottery result is not limited to the tap operation. For example, the user operation for displaying the lottery result may be the operation of fixing a touch position while touching the touch panel (a hold operation), or a slide operation for sliding a finger while touching the touch panel, or may be the operation of rubbing the touch panel. Alternatively, the user operation for displaying the lottery result may be an operation on a button, or may be the operation of moving the smartphone 3 itself (the operation of swinging the smartphone 3, the operation of tilting the smartphone 3, or the like). Yet alternatively, the user operation for displaying the lottery result may be a sound input to the microphone, or may be the operation of blowing the microphone.

Further, the determination condition for the user operation for displaying the lottery result is not limited to the above condition regarding the number of times of the user operation. For example, the determination condition may be a condition regarding the distance of a slide operation, or may be a condition regarding the time in which the user continues a predetermined operation, or may be a condition regarding the angle of tilt of the smartphone 3, or may be a condition regarding the magnitude of a sound input to the microphone. The determination condition (e.g., the number of times of the operation, the operation distance, the operation continuation time, or the like) differs in accordance with the lottery result. It should be noted that it may be determined whether or not an operation satisfying the determination condition is performed by a single operation, or it may be determined whether or not an operation satisfying the determination condition is performed by multiple operations. For example, in a case where the determination condition is a condition regarding the operation distance or a condition regarding the operation continuation time, and when the operation distance or the operation continuation time of a single operation satisfies the condition, the lottery result may be displayed. Alternatively, when the total value (the accumulation value) of multiple operations satisfies the condition, the lottery result may be displayed. Yet alternatively, when the combination of a plurality of types of operations satisfies the condition, the lottery result may be displayed. For example, when the number of times of the operation satisfies the condition, and thereafter, when the operation distance satisfies the condition, the lottery result may be displayed.

That is, on the premise that the user is caused to perform a predetermined user operation (a tap operation, a hold operation, a slide operation, a button operation, the operation of moving the smartphone 3, the operation of blowing the microphone, or the like), a determination condition regarding the amount of the user operation is set to differ in accordance with the lottery result. Then, in accordance with the fact that the operation performed by the user satisfies the determination condition, the lottery result may be displayed. For example, "the amount of the user operation" may be the number of times of the tap operation, or may be the continuation time of the hold operation. Alternatively, "the amount of the user operation" may be the distance of the slide operation, or may be the time in which the slide operation is continuously performed. Yet alternatively, "the amount of the user operation" may be the number of times of the button operation, or may be the time in which the button operation is continuously performed. Yet alternatively, "the amount of the user operation" may be the amount of change in the orientation of the smartphone 3, or may be the sum of distances at which the smartphone 3 is moved, or may be the accumulation value of accelerations detected by moving the smartphone 3. Yet alternatively, "the amount of the user operation" may be the time in which the user blows the microphone, or may be the sound volume of a sound detected by the microphone.

(Example of Lottery Representation)

Figure 8:
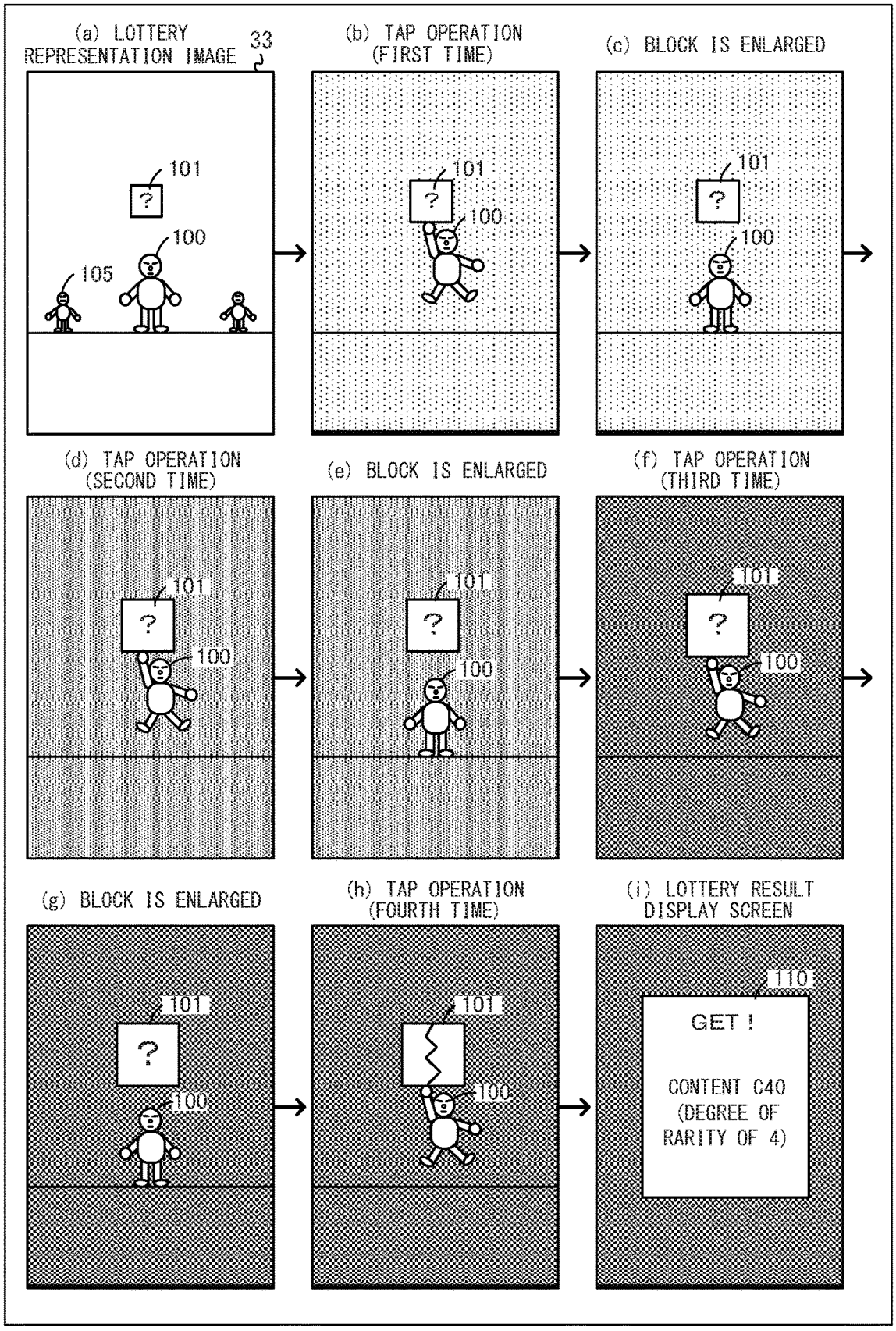
FIG. 8 is an example non-limiting diagram showing an example of lottery representation displayed on a screen of the smartphone 3 after the user clears the predetermined game.

Next, a description is given of the lottery representation executed in the smartphone 3 (the processes of the above steps S5 to S8). FIG. 8 is a diagram showing an example of lottery representation displayed on the screen of the smartphone 3 after the user clears the predetermined game.

When the content lottery is held, the smartphone 3 displays an image of lottery representation shown in (a) of FIG. 8. Specifically, on the screen of the display section 33, the player character 100 and the block 101 having appeared during the execution of the predetermined game are displayed. Further, friend characters 105 are displayed behind the player character 100. The friend characters 105 are displayed before a user operation is performed. It should be noted that the friend characters 105 may continue to be displayed also after the user operation is performed (in and after (b) of FIG. 8), or may not be displayed after the user operation is performed.

After the image shown in (a) of FIG. 8 is displayed, and when a tap operation (a first tap operation) on the screen of the display section 33 is performed, the state where the player character 100 jumps in the virtual space is displayed, and the state where the player character 100 hits the block 101 is displayed ((b) of FIG. 8: here referred to as a "first block hitting"). When the player character 100 hits the block 101, the block 101 is enlarged ((b) and (c) of FIG. 8). Further, in addition to the representation for enlarging the block 101, another type of representation using an image and a sound is also performed.

For example, in accordance with the fact that the player character 100 hits the block 101, a sound effect is output, and also a background image except for the player character 100 and the block 101 becomes darker than in (a) of FIG. 8. Further, in accordance with the fact that the player character 100 hits the block 101, BGM (background music) may change. Further, in accordance with the fact that the player character 100 hits the block 101, for example, at least one of images of the player character 100, the block 101, the background image, and another object may be brightened. Further, in accordance with the fact that the player character 100 hits the block 101, for example, an effect (display for emphasizing an image) may be created on at least one of images of the player character 100, the block 101, the background image, and another object. Further, in accordance with the fact that the player character 100 hits the block 101, the smartphone 3 may be vibrated.

In the state of (c) of FIG. 8, when the user further performs a tap operation (a second tap operation), the state where the player character 100 jumps in the virtual space is displayed, and the state where the player character 100 hits the block 101 is displayed ((d) of FIG. 8: here referred to as a "second block hitting"). When the second block hitting is performed, the block 101 is further enlarged ((d) and (e) of FIG. 8). Further, also in the second block hitting, a sound effect is output, and also the background image becomes darker than in (c) of FIG. 8. Here, different sound effects may be output or the same sound effect may be output between the first block hitting and the second block hitting. Further, the sound volume may be greater (or smaller) in the second block hitting than in the first block hitting. Further, in accordance with the second block hitting, the BGM may change. Further, also in the second block hitting, for example, at least one of images of the player character 100, the block 101, the background image, and another object may be brightened, or an effect may be created on this image. Further, in accordance with the second block hitting, the smartphone 3 may be vibrated. At this time, the smartphone 3 may be vibrated more greatly or vibrated longer in the second block hitting than in the first block hitting. Further, the smartphone 3 may be vibrated in vibration patterns different between the first block hitting and the second block hitting. As described above, representation different between the first block hitting and the second block hitting (representation using a different sound, different display, or a different vibration) is performed, whereby it is possible to further increase the user's sense of anticipation.

In the state of (e) of FIG. 8, when the user further performs a tap operation (a third tap operation), the state where the player character 100 jumps in the virtual space is displayed, and the state where the player character 100 hits the block 101 is displayed ((f) of FIG. 8: here referred to as a "third block hitting"). When the third block hitting is performed, the block 101 is further enlarged ((f) and (g) of FIG. 8). Further, also in the third block hitting, a sound effect is output, and also the background image becomes darker than in (e) of FIG. 8. In the third block hitting, a sound effect different from, or the same sound effect as, that in the first and second block hittings may be output. Further, the sound volume may be larger (or smaller) in the third block hitting than in the first and second block hittings. Further, in accordance with the third block hitting, the BGM may change. Further, also in the third block hitting, for example, at least one of images of the player character 100, the block 101, the background image, and another object may be brightened, or an effect may be created on this image. Further, in accordance with the third block hitting, the smartphone 3 may be vibrated. At this time, the smartphone 3 may be vibrated more greatly or vibrated longer in the third block hitting than in the second block hitting. Further, in the third block hitting, the smartphone 3 may be vibrated in a vibration pattern different from those in the first and second block hittings.

In the state of (g) of FIG. 8, when the user further performs a tap operation (a fourth tap operation), the state where the player character 100 jumps in the virtual space is displayed, and the state where the player character 100 hits the block 101 is displayed ((h) of FIG. 8: here referred to as a "fourth block hitting"). When the fourth block hitting is performed, the block 101 is broken, and a lottery result image 110 is displayed ((i) of FIG. 8). In the example of (i) of FIG. 8, the lottery result image 110 indicating that the content selected by the content lottery is the content C40, which has a degree of rarity of 4, is displayed.

FIG. 8 shows lottery representation in a case where the lottery result is the content C40, which has a degree of rarity of 4. However, in accordance with the degree of rarity of the content selected by the content lottery, the number of times of a block hitting until the lottery result is displayed differs. For example, when the lottery result is the content C30, which has a degree of rarity of 3, then in accordance with the fact that the block hitting (the tap operation of the user) is performed three times, the lottery result image 110 is displayed. Further, when the lottery result is the content C60, which has a degree of rarity of 6, then in accordance with the fact that the block hitting (the tap operation of the user) is performed six times, the lottery result image 110 is displayed.

It should be noted that when the lottery result is displayed, representation different in accordance with the degree of rarity of the content is performed. The higher the degree of rarity, the more flashy representation is performed. For example, the higher the degree of rarity, the more largely the lottery result image 110 indicating the lottery result may be displayed. Further, the higher the degree of rarity, the more flashy the color or the pattern of the effect, or the greater the effect. Further, the higher the degree of rarity, the more flashy sound effect may be output, or the larger the sound volume of the sound effect. Further, the higher the degree of rarity, the darker the background image and the brighter the lottery result image 110. Further, when the lottery result is displayed, the higher the degree of rarity, the more greatly the smartphone 3 may be vibrated.

Further, in the example of the lottery representation, every time the tap operation is performed by the user, the size of the block 101 changes, or a sound effect is output, or the BGM changes, or the background image is darkened (or brightened). In another exemplary embodiment, when the number of times of the tap operation reaches the number of times determined in advance, representation using an image, a sound, a vibration, or the like may change. For example, in accordance with the fact that the third and fifth tap operations are performed, the above representation may change. Further, there may be representation that changes every time the tap operation is performed, and representation that changes when the number of times of the tap operation reaches the number of times determined in advance. For example, every time the tap operation is performed, the block 101 may be enlarged, and in accordance with the fact that the third and fifth tap operations are performed, the background image may be darkened.

As described above, in the exemplary embodiment, to display the lottery result, a user operation corresponding to the lottery result is required. Thus, it is possible to give the user the impression that the user gains a content by their own operation.

Further, the higher the degree of rarity of the content selected by the content lottery, the greater the number of times of the operation performed by the user. Thus, it is possible to increase the user's sense of anticipation. Further, every time the user performs the operation, lottery representation before the lottery result is displayed changes. Thus, it is possible to gradually increase the user's sense of anticipation until the lottery result is displayed. For example, every time the user performs the operation, a sound effect is output, or the screen is darkened. Thus, it is possible to give the user a sense of anticipation regarding what content will appear when the user performs the operation next. Further, it is possible to make the user want a content not to appear when the user performs the operation next (want the operation to continue). Thus, it is possible to make the user feel anticipation and anxiety. As described above, a user operation is inserted before the lottery result is displayed, whereby it is possible to improve interest.

Figure 9:
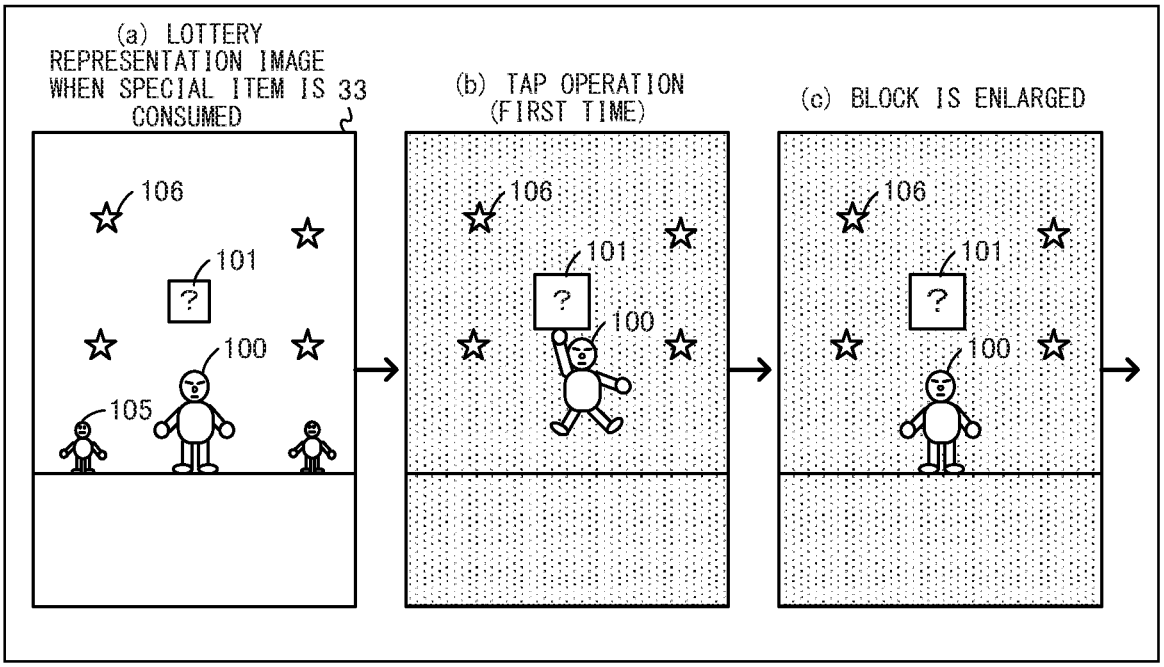
FIG. 9 is an example non-limiting diagram showing an example of an image of lottery representation executed in a case where the user consumes a special item.

It should be noted that FIG. 8 shows the screen of the lottery representation in a case where the user clears the predetermined game. However, when the user consumes a special item, lottery representation in a form different from that in FIG. 8 is executed. FIG. 9 is a diagram showing an example of an image of lottery representation executed when the user consumes a special item.

As shown in FIG. 9, when the content lottery is held by the user consuming a special item, star objects 106 are displayed in addition to the player character 100 and the block 101 on a screen of lottery representation. As described above, when the user consumes a special item, it is more likely that a content having a high degree of rarity is selected than when the user clears the predetermined game. Thus, the star objects 106 can indicate to the user that there is a high degree of expectation that a content having a high degree of rarity will be selected. Further, when the user consumes a special item, the player character 100 and/or the block 101 may be displayed in display forms different from those in FIG. 8. For example, when the user consumes a special item, the player character 100 may shine, or the block 101 may rotate. Also when the user consumes a special item, similarly to when the user clears the predetermined game, then in accordance with the fact that a tap operation is performed the number of times corresponding to the degree of rarity, the lottery result is displayed.

Further, in accordance with the degree of rarity of the content selected by the content lottery, presage representation is executed. The "presage representation" is representation executed before the result of the content lottery is displayed and before a user operation is performed, and is also representation suggesting that there is a high possibility that a content having a high degree of rarity is selected.

For example, in the content lottery, when a content having a degree of rarity of "3" or "4" is selected in accordance with the table shown in FIG. 5 or 6, the presage representation is performed with a probability of 50%. Further, in the content lottery, when a content having a degree of rarity of "5" or "6" is selected in accordance with the table shown in FIG. 5 or 6, the presage representation is performed with a probability of 80%. As described above, in accordance with the degree of rarity of the content, it is determined whether or not the presage representation is to be executed with a different probability.

Figure 10:
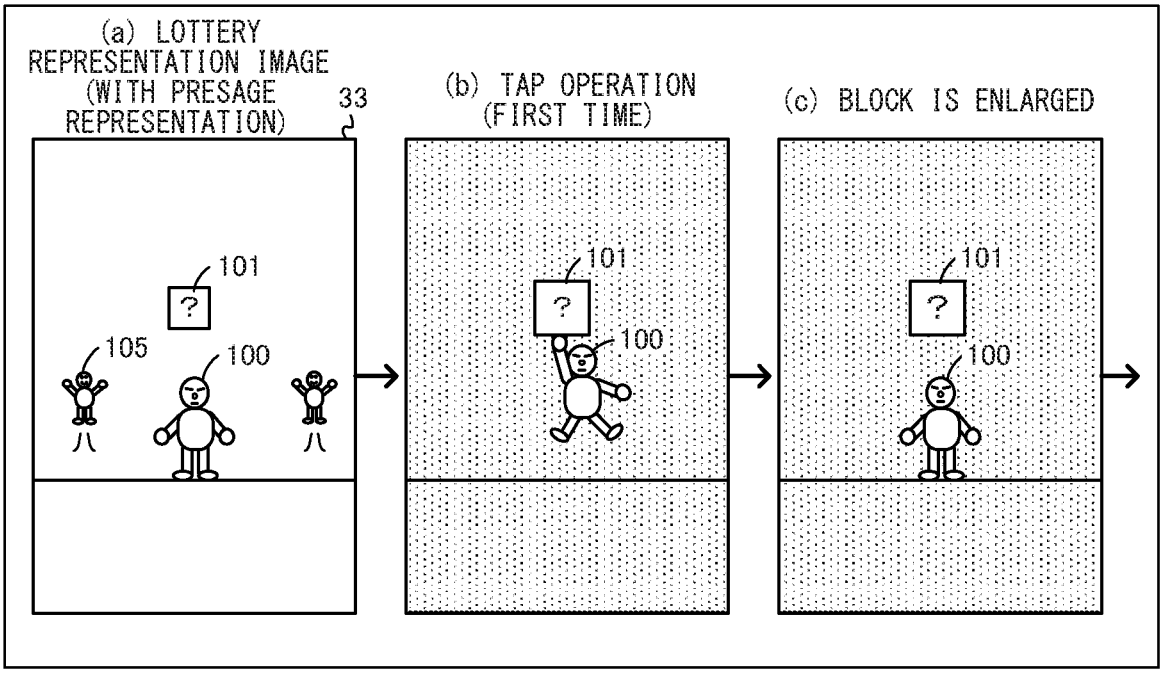
FIG. 10 is an example non-limiting diagram showing an example of presage representation.

FIG. 10 is a diagram showing an example of the presage representation. For example, as shown in FIG. 10, as the presage representation, the state where the friend characters 105 jump is displayed. Further, in the presage representation, the types, the number, or the actions of the friend characters 105 may be different in accordance with the degree of rarity of the content selected by the content lottery. For example, the higher the degree of rarity of the content, the greater the number of the friend characters 105. Further, for example, the higher the degree of rarity of the content, the larger actions the friend characters 105 may perform. In addition, the presage representation may be performed based on an image, a sound, the display form or the action form of the player character 100, the display form of the block 101, the brightnesses of the background image and/or the entire screen, a vibration, or the like.

As shown in (a) of FIG. 10, the presage representation is executed at least before a first user operation shown in (b) of FIG. 10 is performed. The number of times of the user operation (the amount of the user operation) necessary until the result of the content lottery is displayed is different in accordance with the degree of rarity of the content selected by the lottery. Thus, the presage representation can be said to suggest the lottery result and also suggest the number of times of the user operation (the amount of the user operation) necessary until the lottery result is displayed. For example, when the presage representation shown in (a) of FIG. 10 is performed, the user recognizes that the number of times of the operation performed by the user themselves is at least three times (i.e., the degree of rarity is "3" or more). Then, the user anticipates that the number of times of the operation is five or more times (i.e., the degree of rarity is "5" or more).

Thus, with the presage representation, it is possible to suggest in advance the number of times of the operation to be performed by the user from now, and it is possible to increase the user's sense of anticipation. It should be noted that the presage representation may continue to be performed also after the user operation is performed.

(Details of Processing)

Next, a description is given of the details of processing performed by each smartphone 3 and the server 2. First, data stored in the smartphone 3 and the server 2 is described, and then, information processing performed by the smartphone 3 and the server 2 is described.

Figure 11:
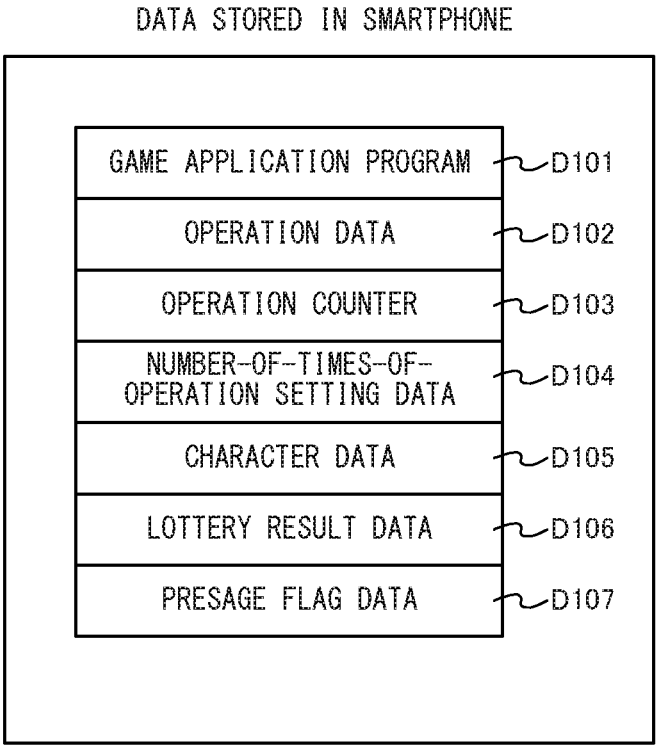
FIG. 11 is an example non-limiting diagram showing an example of data stored in the smartphone 3.

FIG. 11 is a diagram showing an example of data stored in the smartphone 3. As shown in FIG. 11, (a memory and the storage section 34 of) the smartphone 3 stores a game application program D101, operation data D102, an operation counter D103, number-of-times-of-operation setting data D104, character data D105, lottery result data D106, and presage flag data D107. It should be noted that the smartphone 3 also stores various types of data and programs in addition to the data and the like shown in FIG. 11.

The game application program D101 is a program for executing the game application including the above predetermined game. The game application program D101 includes a program for executing the above predetermined game and a program for executing the above lottery representation.

The operation data D102 is data indicating a touch position detected by the touch panel 32. The operation counter D103 is data for counting the number of times of a tap operation performed by the user. The number-of-times-of-operation setting data D104 is data indicating the number of times of a user operation necessary until a lottery result is displayed. The number-of-times-of-operation setting data D104 is set in accordance with the result of a content lottery executed by the server 2.

The character data D105 is data including information regarding the position, the action (whether or not the player character 100 jumps), and the like of the player character 100.

The lottery result data D106 is data indicating a lottery result acquired from the server 2 and is data regarding a content selected by a content lottery in the server 2.

The presage flag data D107 is data indicating whether or not the above presage representation is to be performed.

Figure 12:
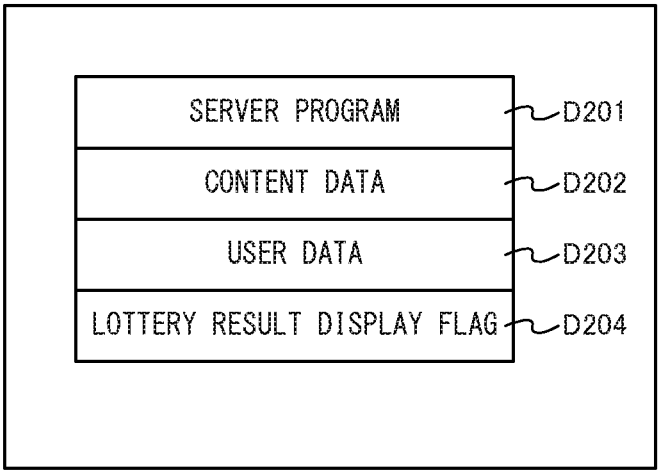
FIG. 12 is an example non-limiting diagram showing an example of data stored in a server 2.

FIG. 12 is a diagram showing an example of data stored in the server 2. As shown in FIG. 12, (a memory and a storage device of) the server 2 stores a server program D201, content data D202, user data D203, and a lottery result display flag D204. It should be noted that the server 2 also stores various types of data and programs in addition to the data and the like shown in FIG. 12.

The server program D201 is a program for executing processing shown in FIG. 16, which will be described later. The server program D201 includes a lottery program for executing a content lottery.

The content data D202 is data indicating a plurality of contents to be given to the user.

The user data D203 is data regarding the user of each smartphone 3. The user data D203 includes data regarding each smartphone 3 (each user). Specifically, the user data D203 includes data indicating a content acquired by a content lottery by each user. Further, the user data D203 includes data indicating an item, such as a special item, owned by the user.

The lottery result display flag D204 is data indicating whether or not each smartphone 3 displays a lottery result. The lottery result display flag D204 is prepared for each user (each smartphone 3).

(Details of Processing of Smartphone 3)

Figure 13:
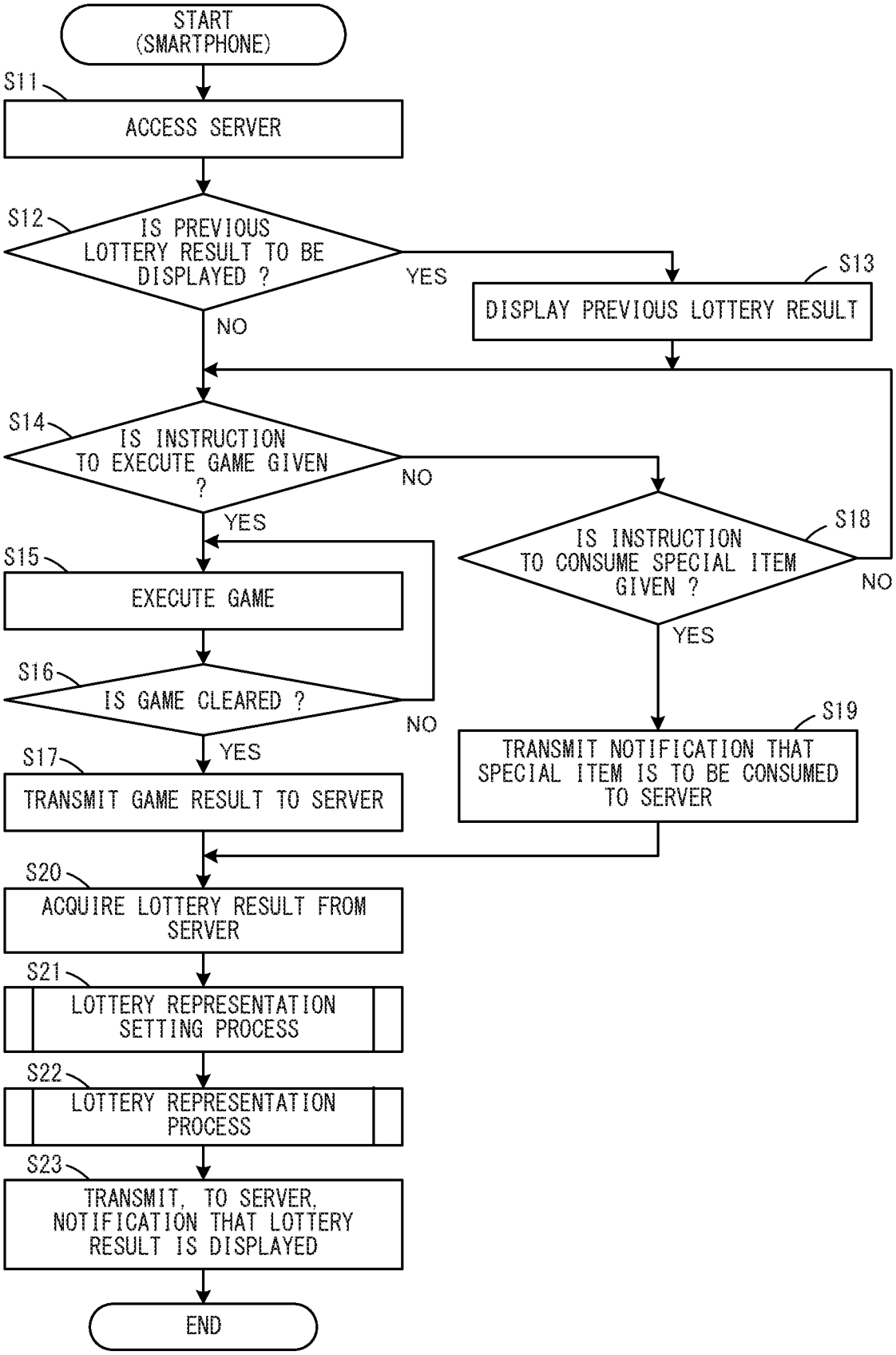
FIG. 13 is an example non-limiting flow chart showing the details of processing performed by the smartphone 3.

Next, a description is given of the details of the processing performed by each smartphone 3. FIG. 13 is a flow chart showing the details of the processing performed by the smartphone 3. The processing shown in FIG. 13 is performed by the processing section 31 of the smartphone 3 executing the game application program D101 (an information processing program). When an icon corresponding to the game application according to the exemplary embodiment is tapped in the smartphone 3, the processing shown in FIG. 13 is started.

As shown in FIG. 13, first, the processing section 31 of the smartphone 3 (hereinafter simply referred to as the "smartphone 3") accesses the server (step S11). In step S11, the smartphone 3 transmits to the server 2 a notification that the game application is to be executed. Then, the smartphone 3 acquires data saved in the server 2 (data necessary for the execution of the game application, such as data regarding an item owned by the user) from the server. Here, the smartphone 3 acquires from the server 2 the lottery result display flag 5205 indicating whether or not the previous lottery result is displayed on the smartphone 3.

Next, the smartphone 3 determines whether or not the previous lottery result is to be displayed (step S12). Specifically, based on the lottery result display flag 5205, the smartphone 3 determines whether or not the previous lottery result is to be displayed. When it is determined that the previous lottery result is to be displayed (step S12: YES), the smartphone 3 displays the previous lottery result on the display section 33 (step S13). For example, when the game application is ended after a content is acquired from the server 2 in the previous lottery and before the lottery result screen shown in (i) of FIG. 8 is displayed, the game application ends without the user viewing the previous lottery result. In such a case, when the game application is started next, the smartphone 3 displays the previous lottery result in step S13.

When the determination is NO in step S12, or when the process of step S13 is performed, the smartphone 3 displays a top screen of the game application and determines whether or not the user gives an instruction to execute a predetermined game on the top screen (step S14).

When an instruction to execute the predetermined game is given (step S14: YES), the smartphone 3 executes the predetermined game (step S15). Consequently, for example, a game screen as shown in FIG. 4 is displayed, and the predetermined game is started. During the execution of the predetermined game, the player character 100 performs an action in accordance with a user operation. As described above, the predetermined game includes one or more stages, and the user plays games in one or more stages in step S15.

Next, the smartphone 3 determines whether or not the predetermined game is cleared (step S16). For example, when a predetermined number of stages are cleared (when a goal is reached in each stage), or when games in a predetermined number of stages are executed (when games in a plurality of stages are executed, regardless of whether or not a goal is reached in each stage), the smartphone 3 determines that the game is cleared. When the predetermined game is not cleared (step S16: NO), the smartphone 3 executes the process of step S15 again.

When the predetermined game is cleared (step S16: YES), the smartphone 3 transmits the result of the predetermined game to the server 2 (step S17). Here, the smartphone 3 transmits a request to execute a content lottery together with the result of the predetermined game to the server 2.

On the other hand, when an instruction to execute the predetermined game is not given (step S14: NO), the smartphone 3 determines whether or not an instruction to consume a special item is given by the user (step S18). For example, the smartphone 3 determines whether or not an icon for giving an instruction to consume a special item is tapped on the top screen of the game application. When an instruction to consume a special item is not given (step S18: NO), the smartphone 3 executes the process of step S14 again.

When an instruction to consume a special item is given (step S18: YES), the smartphone 3 transmits to the server 2 a notification indicating that a special item is to be consumed (step S19). Here, the smartphone 3 transmits to the server 2 a request to execute a content lottery, together with the notification indicating a special item is to be consumed.

When the process of step S17 is executed, or when the process of step S19 is executed, the smartphone 3 acquires a lottery result from the server 2 (step S20). Specifically, the smartphone 3 acquires from the server 2 a content selected by a content lottery and saves the acquired content as the lottery result data D106.

It should be noted that the smartphone 3 may acquire, from the server 2, data of the content itself selected by the content lottery. Alternatively, data of the content itself may be saved in advance in the smartphone 3, and the smartphone 3 may acquire from the server 2 a key for enabling the content. Until the key is acquired, the content is locked. Then, when the key is received from the server 2, the content is unlocked, and the smartphone 3 may be able to use the content.

Figure 14:
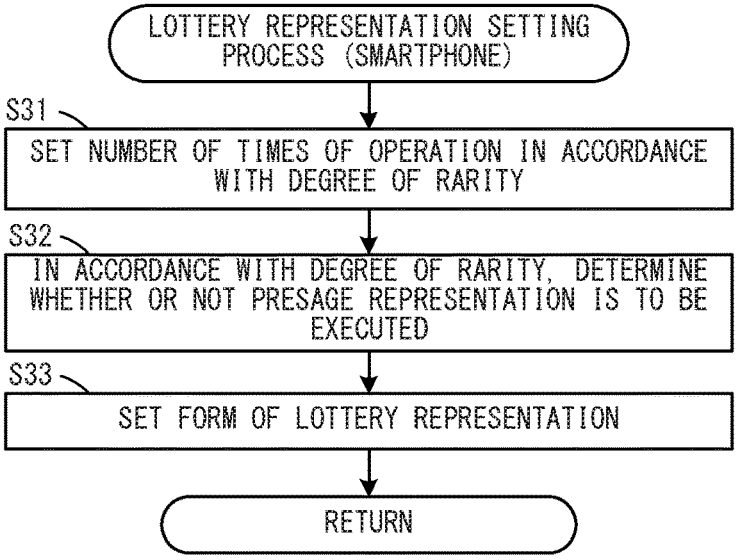
FIG. 14 is an example non-limiting flow chart showing the details of a lottery representation setting process in step S21.

Subsequently, the smartphone 3 executes a lottery representation setting process (step S21). A description is given below of the details of the lottery representation setting process in step S21. FIG. 14 is a flow chart showing the details of the lottery representation setting process in step S21.

As shown in FIG. 14, based on the result of the content lottery acquired from the server 2, the smartphone 3 sets the number of times of an operation (step S31). Specifically, in accordance with the degree of rarity of the content selected by the content lottery, the smartphone 3 determines the number of times of a user operation to be performed until the lottery result is displayed. Then, the smartphone 3 sets the determined number of times to the number-of-times-of-operation setting data D104. For example, when a content having a degree of rarity of "1" is selected by the content lottery, the smartphone 3 sets "1" to the number-of-times-of-operation setting data D104. When a content having a degree of rarity of "3" is selected, the smartphone 3 sets "3" to the number-of-times-of-operation setting data D104.

After step S31, in accordance with the degree of rarity of the content selected by the content lottery, the smartphone 3 determines whether or not presage representation is to be executed (step S32). For example, when a content having a degree of rarity of "1" or "2" is selected, the smartphone 3 determines that the presage representation is not to be executed. Further, when a content having a degree of rarity of "3" or "4" is selected, the smartphone 3 determines that the presage representation is to be executed with a probability of 50%. Further, when a content having a degree of rarity of "5" or "6" is selected, the smartphone 3 determines that the presage representation is to be executed with a probability of 80%. When it is determined that the presage representation is to be executed, the smartphone 3 saves in the presage flag data D107 a value indicating that the presage representation is to be executed.

Next, the smartphone 3 sets the form of lottery representation (step S33). Specifically, when the content lottery is held as a result of the fact that the predetermined game is cleared, the smartphone 3 sets the representation form shown in FIG. 8 as the form of the lottery representation. Further, when the content lottery is held as a result of the fact that a special item is consumed, the smartphone 3 sets the representation form shown in FIG. 9 as the form of the lottery representation. When the process of step S33 is executed, the smartphone 3 ends the processing shown in FIG. 14.

Figure 15:
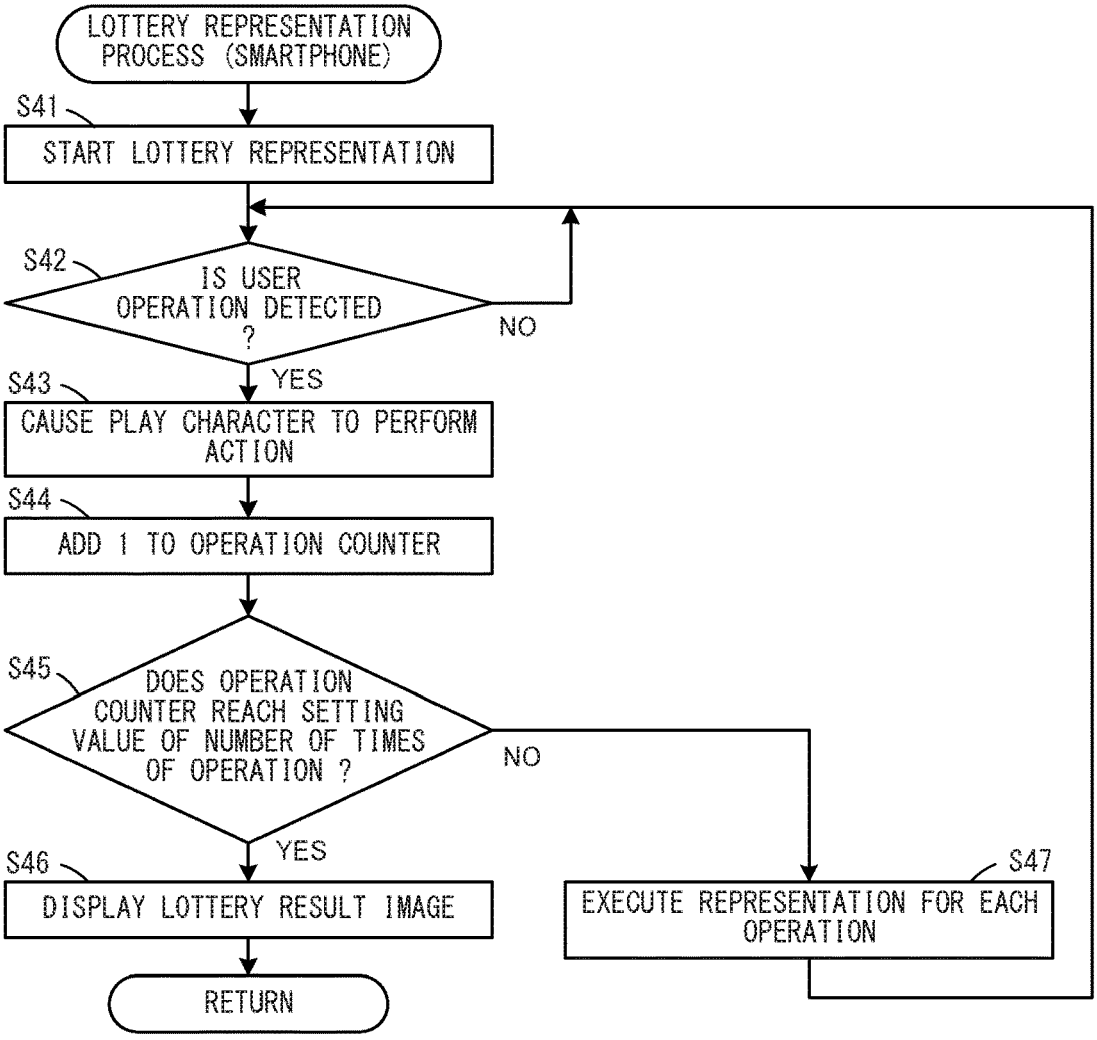
FIG. 15 is an example non-limiting flow chart showing the details of a lottery representation process in step S22.

Referring back to FIG. 13, after step S21, the smartphone 3 executes a lottery representation process (step S22). Here, the lottery representation process in step S22 is the process of executing the lottery representation for displaying the lottery result exemplified in FIG. 8. A description is given below of the details of the lottery representation process in step S22. FIG. 15 is a flow chart showing the details of the lottery representation process in step S22.

Based on the result of the lottery representation setting process, the smartphone 3 starts the lottery representation (step S41). For example, when it is determined in step S32 that the presage representation is to be executed, the smartphone 3 executes the presage representation on a start screen ((a) of FIG. 10) of the lottery representation. Further, the smartphone 3 starts executing the lottery representation in the form determined in step S33.

Next, the smartphone 3 determines whether or not the user operation is detected (step S42). Specifically, based on a touch position acquired from the touch panel 32, the smartphone 3 determines whether or not the user operation (specifically, a tap operation) is performed. When the user operation is not detected (step S42: NO), the smartphone 3 performs the process of step S42 again.

When the user operation is detected (step S42: YES), the smartphone 3 causes the player character 100 to perform an action (step S43). Consequently, the state where the player character 100 jumps and hits one of the blocks 101 is displayed on the screen of the display section 33. Next, the smartphone 3 adds "1" to the operation counter D103 stored in the memory (step S44).

Subsequently, the smartphone 3 determines whether or not the value indicated by the operation counter D103 and obtained by adding "1" in step S44 reaches the value set to the number-of-times-of-operation setting data D104 (step S45).

When it is determined that the value indicated by the operation counter D103 reaches the value set to the number-of-times-of-operation setting data D104 (step S45: YES), the smartphone 3 displays on the display section 33 the lottery result image 110 indicating the lottery result (see (i) of FIG. 8) (step S46). In step S46, the lottery result image 110 is displayed, and a sound (a sound effect) is also output. For example, an image of a character selected by the content lottery, letters, an image indicating the degree of rarity of the selected character, or the like may be displayed. At this time, the higher the degree of rarity of the content (i.e., the lower the lottery probability of the content), the more largely the lottery result image 110 may be displayed. Further, in accordance with the degree of rarity of the content, an effect may be created on the lottery result image 110. Further, the higher the degree of rarity of the content, the greater the difference in brightness between the background image and the lottery result image 110 indicating the content. For example, the higher the degree of rarity of the content, the more darkly the background image may be displayed, or the more brightly the lottery result image 110 may be displayed. Further, a sound different in accordance with the degree of rarity of the content is output. The higher the degree of rarity of the content, the louder sound may be output, or the more flashy sound may be output. Further, the lottery result image 110 may be displayed, and simultaneously, the smartphone 3 may be vibrated. In this case, the higher the degree of rarity of the content, the more strongly the smartphone 3 may be vibrated, or the longer the smartphone 3 may be vibrated. When the process of step S46 is executed, the smartphone 3 ends the processing shown in FIG. 15.

On the other hand, when it is determined that the value indicated by the operation counter D103 does not reach the value set to the number-of-times-of-operation setting data D104 (step S45: NO), the smartphone 3 executes representation for each operation (step S47). For example, every time the tap operation is performed, the smartphone 3 enlarges the block 101, or outputs a sound effect, or darkens (or brightens) a background screen, or changes BGM, or generates a vibration. In this case, every time the user operation is detected, the smartphone 3 may execute the above representation. Alternatively, only when the user operation is performed for a predetermined number of times (e.g., the second and fourth times), the smartphone 3 may execute the above representation. When the process of step S47 is executed, the smartphone 3 executes the process of step S42 again.

Referring back to FIG. 13, after the lottery representation process in step S22, the smartphone 3 transmits to the server 2 a notification indicating that the current lottery result is displayed on the smartphone 3 (step S23). Consequently, the server 2 records the fact that the current lottery result is displayed on the smartphone 3.

(Details of Processing of Server 2)

Next, a description is given of the details of the processing performed by the server 2. FIG. 16 is a flow chart showing the details of the processing performed by the server 2. The processing shown in FIG. 16 is performed by the CPU of the server 2 executing the server program D201 (an information processing program).

Figure 16:
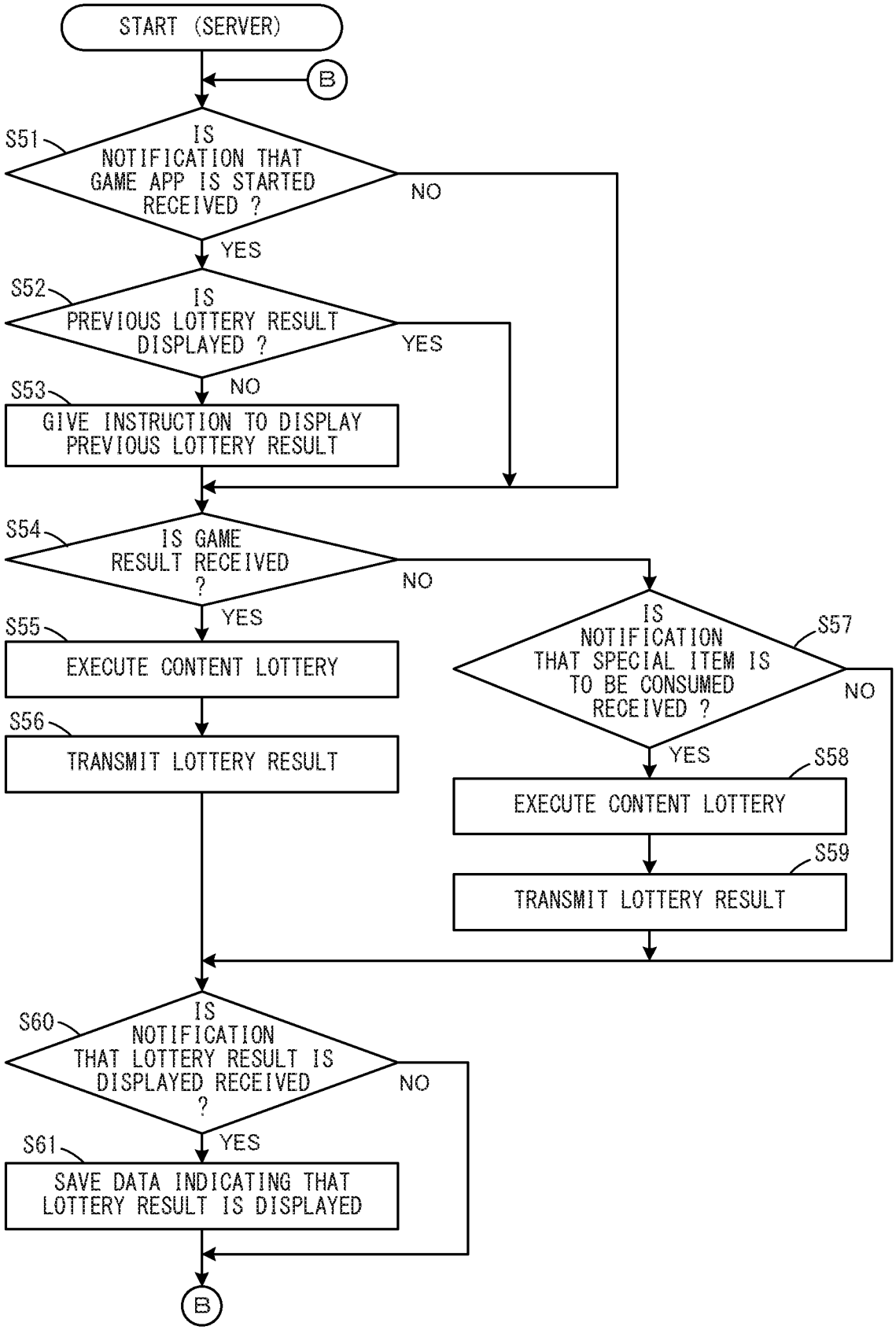
FIG. 16 is an example non-limiting flow chart showing the details of processing performed by the server 2.

As shown in FIG. 16, the CPU of the server 2 (hereinafter simply referred to as the "server 2") determines whether or not a notification that the game application is started is received from the smartphone 3 (step S51). When the process of step S11 is performed by the smartphone 3, the smartphone 3 transmits this notification to the server 2, and the server 2 receives the notification.

When a notification that the game application is started is received from the smartphone 3 (step S51: YES), the server 2 determines whether or not the smartphone 3 having transmitted this notification displays the result of the previous content lottery (step S52). Specifically, with reference to the lottery result display flag D204 corresponding to the smartphone 3 having transmitted the notification, the server 2 determines whether or not the smartphone 3 displays the lottery result of the previous content lottery. When the smartphone 3 previously holds a content lottery and displays the lottery result of the previous content lottery, the determination is "YES" in step S52. Further, when the smartphone 3 previously holds a content lottery and does not display the lottery result of the previous content lottery, the determination is "NO" in step S52. It should be noted that the server 2 stores the execution history of a content lottery of each user (each smartphone 3) as the user data D203. When the server 2 does not have the execution history of a content lottery corresponding to the smartphone 3 having transmitted the notification (i.e., when the server 2 has never executed a content lottery in the past based on a request from the smartphone 3), the determination is "YES" in step S52.

When the determination is "NO" in step S52, the server 2 instructs the smartphone 3 to display the result of the previous content lottery, and also transmits predetermined data (data necessary for the execution of the game application and data of an item owned by the user and the like) to the smartphone 3 (step S53). On the other hand, when the determination is "YES" in step S52, the server 2 transmits the predetermined data to the smartphone 3 and next executes the process of step S54.

When the process of step S53 is performed, or when the determination is YES in step S52, or when the determination is NO in step S51, the server 2 determines whether or not the result of the predetermined game is received from the smartphone 3 (step S54). When the result of the predetermined game is transmitted from the smartphone 3 to the server 2 in step S17 in FIG. 13, the determination is "YES" in step S54, and the server 2 executes a content lottery (step S55). In step S55, the lottery is held based on the lottery probabilities exemplified in FIG. 5. Then, the server 2 transmits the result of the content lottery to the smartphone 3 (step S56). Further, the server 2 updates the user data D203 of the user corresponding to the smartphone 3 having transmitted the game result. Specifically, the server 2 saves as the user data D203 the result of the content lottery in step S55 and data indicating that the user clears the predetermined game.

On the other hand, when the result of the predetermined game is not received from the smartphone 3 (step S54: NO), the server 2 determines whether or not a notification that a special item is to be consumed is received from the smartphone 3 (step S57). When a notification that a special item is to be consumed is transmitted from the smartphone 3 to the server 2 in step S19 in FIG. 13, the determination is "YES" in step S57, and the server 2 executes a content lottery (step S58). In step S58, the lottery is held based on the lottery probabilities exemplified in FIG. 6. Then, the server 2 transmits the result of the content lottery to the smartphone 3 (step S59). Further, the server 2 updates the user data D203 of the user corresponding to the smartphone 3 having consumed the special item. Specifically, the server 2 subtracts the special item of the user corresponding to the smartphone 3 and also saves the result of the content lottery in step S58 as the user data D203.

When the process of step S56 is executed, or when the process of step S59 is executed, or when the determination is NO in step S57, the server 2 determines whether or not a notification indicating that the lottery result is displayed is received from the smartphone 3 (step S60). When a notification indicating that the lottery result is displayed in step S23 in FIG. 13 is transmitted to the server 2, and the server 2 receives the notification, the determination is "YES" in step S60. When the determination is YES in step S60, the server 2 saves, as the lottery result display flag D204 corresponding to the smartphone 3, data indicating that the lottery result is displayed on the smartphone 3 (step S61).

When the process of step S61 is executed, or when the determination is NO in step S60, the server 2 executes the process of step S51 again. Thus, the description of FIG. 16 ends.

As described above, in the exemplary embodiment, based on the fact that a user executes a predetermined game, a content lottery for selecting by lot a content to be given to the user from among a plurality of contents is held (steps S55 and S58). A different number of times of an operation is set in accordance with the result of the content lottery (step S31). When the number of times of a tap operation performed by the user reaches the set number of times of the operation (step S45: YES), the result of the content lottery is displayed (step S46).

As described above, before the lottery result is displayed, a user operation corresponding to the lottery result is inserted, whereby it is possible to give the user the impression that the user gains a content by their own operation. Further, a different number of times is set in accordance with the lottery result. Thus, the user performs the operation multiple times until the lottery result is displayed. Thus, it is possible to increase the user's sense of anticipation with respect to each operation. Further, the higher the degree of rarity of the content selected by the lottery, the greater number of times of the user operation to be performed until the lottery result is displayed is set. Thus, when the user performs the operation next, the user has anticipation and anxiety regarding whether or not the lottery result will be displayed. This improves interest.

Further, in the exemplary embodiment, every time the user performs the operation, the block 101 is enlarged, or the background image is darkened. Thus, it is possible to increase the user's sense of anticipation until the lottery result is displayed.

Further, in the exemplary embodiment, in the lottery representation performed before the lottery result is displayed, the representation is performed using the player character 100 and the block 101 having appeared in the predetermined game. Specifically, an action similar to an action in which the player character 100 hits the block 101 in the predetermined game is performed in the lottery representation. Thus, the user can have a feeling that the user plays a game also in the lottery representation. For example, in a case where a lottery is held as a result of the execution of the predetermined game, and if representation not directly related to the predetermined game is performed when the lottery result is displayed, the user may have the impression that the lottery is performed independently of the predetermined game. In the exemplary embodiment, however, representation is performed using the player character 100 and the block 101 having appeared in the predetermined game. Thus, it is possible to present to the user a content given by a lottery, while maintaining the world view of the game.

Further, in the exemplary embodiment, after the lottery is held and before the user operation is performed, presage representation is performed based on the lottery result. By the presage representation, it is possible to increase a sense of anticipation that the lottery result preferable for the user will be displayed, and it is also possible to suggest the number of times of the user operation.

(Variations)

While the exemplary embodiment has been described above, various variations may be made in another exemplary embodiment. For example, the processing shown in FIGS. 13 to 16 is merely an example, and the order of steps may be changed, or another step may be added, or some of the steps may be omitted. Further, at least a part of the processing shown in FIG. 16 may be performed by the smartphone 3. At least a part of the processing shown in FIGS. 13 to 15 may be performed by the server 2. Further, numerical values used in the processes are merely examples, and other values may be used.

For example, in the above exemplary embodiment, the server 2 executes a content lottery and transmits the lottery result to the smartphone 3. In another exemplary embodiment, the smartphone 3 may hold a content lottery.

Further, in the above exemplary embodiment, the lottery representation setting process is performed by the smartphone 3. In another exemplary embodiment, a part or all of the lottery representation setting process may be performed by the server 2.

Further, in the above exemplary embodiment, the data indicating that the smartphone 3 displays the result of the content lottery is saved in the server 2. In another exemplary embodiment, the data indicating that the smartphone 3 displays the result of the content lottery may be saved in the smartphone 3.

Further, in the above exemplary embodiment, in accordance with the degree of rarity of a content selected by a lottery, the number of times of an operation is set, and in accordance with the fact that a tap operation performed by the user reaches the set number of times of the operation, the result of the content lottery is displayed. In another exemplary embodiment, the amount of a predetermined user operation (a tap operation, a hold operation, a slide operation, the operation of moving the smartphone 3, the operation of inputting a voice to the microphone or blowing the microphone, or the like) may be set to differ in accordance with the lottery result. Then, in accordance with the fact that the set amount of the user operation is performed, the lottery result may be displayed. Here, the amount of the user operation set in accordance with the lottery result may be the number of times of the tap, the hold time, the slide distance, the slide time, the distance at which the smartphone 3 is moved, the time in which the smartphone 3 is moved, or the like. Further, the amount of the user operation set in accordance with the lottery result may be the touch area (e.g., the area of the user's finger in contact with the touch panel), or may be the number of times of a multi-touch (the number of touches). Then, in accordance with the fact that the operation performed by the user reaches the set amount, the lottery result may be displayed.

Further, in the above exemplary embodiment, in accordance with the degree of rarity of a content selected by a content lottery, the amount of a user operation is set. In another exemplary embodiment, in a case where the number of contents to be given to the user by a content lottery differs in accordance with the probability, the amount of a user operation may be set in accordance with the number of contents to be given. For example, in a case where predetermined items in the range of 1 to 10 predetermined items are given to the user by a content lottery, the greater the number of predetermined items to be given, the lower the lottery probability may be set. In this case, the larger the number of contents to be given, the larger the amount of a predetermined user operation necessary until the result of the lottery is displayed (e.g., the number of times of a tap or the slide distance) may be set. Further, in another exemplary embodiment, when there is a content to be given in a case where a content lottery is held in a particular period, the amount of a predetermined user operation may be set in accordance with a content given for a limited time in accordance with the lottery result.

Further, in another exemplary embodiment, in accordance with a lottery result, the type of user operation (e.g., a tap operation, a hold operation, flick operation, a button operation, or the like) may be set, and in accordance with the fact that the set type of operation is performed by the user, the lottery result may be displayed. Further, in accordance with the fact that the velocity of the user operation satisfies a condition, the lottery result may be displayed. For example, in accordance with the fact that the velocity (the number of times of the operation per unit time) of the tap operation or the button operation, or the velocity of the slide operation satisfies a condition, the lottery result may be displayed.

That is, a determination condition regarding the amount, the type, the velocity, or the like of a user operation (a determination condition regarding a user operation) is set in accordance with a lottery result, and in accordance with the fact that the user operation satisfying the set determination condition is performed, the lottery result may be displayed.

Further, in the above exemplary embodiment, the lottery probabilities of contents are fixed regardless of the execution result of the game. In another exemplary embodiment, the lottery probabilities of the contents may be changed in accordance with the execution result of the game. For example, when points may be given during or after the execution of the predetermined game, or when the player character 100 acquires an item during the execution of the predetermined game, the more points are given, or the more items are acquired, the more likely a content having a high degree of rarity may be selected.

Further, in another exemplary embodiment, not only in the smartphone 3 but also in any other information processing apparatus (e.g., a game apparatus, a personal computer, a tablet terminal, a wristwatch-type terminal, an eyeglass-type terminal, or the like), the predetermined game may be performed, or the user operation may be performed, or the lottery result may be displayed. Further, for example, an input device for receiving the user operation and a display device for displaying the lottery result may be formed of different devices.

While the exemplary embodiment has been described, the above description is merely illustrative, and the exemplary embodiment may be improved and modified in various manners.

While certain example systems, methods, devices and apparatuses have been described herein, it is to be understood that the appended claims are not to be limited to the systems, methods, devices and apparatuses disclosed, but on the contrary, are intended to cover various modifications and equivalent arrangements included within the spirit and scope of the appended claims.

What is claimed is:

1. A computer system comprising:

a processing system that includes at least one hardware processor, the processing system configured to:

obtain a result based on execution of a computer process that selects, from among a plurality of virtual content items, at least one virtual content item to be provided to a user, where each of the plurality of virtual content items are associated with a degree of rarity;

set a reveal condition for the obtained result, the reveal condition differing based on the degree of rarity of the at least one virtual item that is associated with the obtained result, wherein different reveal conditions correspond to different user operation amounts;

process at least one user operation that is provided, via an input device that is coupled to the processing system, in connection with revealing the obtained results; and output, to a display, the obtained result based on determination that the processed at least one user operation satisfies the reveal condition for the obtained result.

2. The computer system of claim 1, wherein the processing system is further configured to:

output, to the display, a presage representation that is dependent on the degree of rarity of the at least one virtual content item.

3. The computer system of claim 2, wherein the presage representation is output prior to a user providing the at least one user operation.

4. The computer system of claim 2, wherein the processing system is further configured to perform a presage determination as to whether or not to output the presage representation, wherein the presage determination is based on the degree of rarity of the at least one virtual content item.

5. The computer system of claim 1, wherein the at least one user operation includes at least one of a slide operation, a detected motion operation, detected tilt operation, detected sound operation, and detected vibration operation.

6. The computer system of claim 1, wherein the reveal condition is a number of times that the at least one user operation is to be performed.

7. The computer system of claim 1, wherein a number of user operations for the reveal condition is proportional to the degree of rarity of the at least one virtual content item associated with obtained result.

8. The computer system of claim 1, wherein the user operation is a touch operation, and wherein the reveal condition varies an amount regarding the touch operation as a function of the obtained result.

9. The computer system of claim 1, wherein the processing system is further configured to display an image on the display as a first representation, and in accordance with the amount of the user operation performed by the user, the image is changed.

10. A non-transitory storage medium having stored therein an information processing program for execution by at least one hardware processor of an information processing system, the information processing program comprising instruction that, when executed by the at least one hardware processor, cause the at least one hardware processor to:

obtain a result based on execution of a selection process that selects, from among a plurality of virtual content items, at least one virtual content item to be provided to a user, where each of the plurality of virtual content items are associated with a degree of rarity;

set a reveal condition for the obtained result, the reveal condition differing so that increased rarity of the selected at least one virtual content item corresponds to a larger amount of user operations set in connection with the reveal condition;

process at least one user operation that is provided, via an input device that is coupled to the information processong sustem, in connection with revealing the obtained results; and output, to a display, the obtained result based on determination that the processed at least one user operation satisfies the reveal condition for the obtained result.

11. The non-transitory storage medium of claim 10, wherein the information processing program comprises further instructions that, when executed by the at least one hardware processor, cause the at least one hardware processor to:

output, to the display, a presage representation that is dependent on the degree of rarity of the at least one virtual content item.

12. The non-transitory storage medium of claim 11, wherein the presage representation is output prior to a user providing the at least one user operation.

13. The non-transitory storage medium of claim 11, wherein the information processing program comprises further instructions that, when executed by the at least one hardware processor, cause the at least one hardware processor to:

perform a presage determination as to whether or not to output the presage representation, wherein the presage determination is based on the degree of rarity of the at least one virtual content item.

14. The non-transitory storage medium of claim 10, wherein the at least one user operation includes at least one of a slide operation, a detected motion operation, detected tilt operation, detected sound operation, and detected vibration operation.

15. The non-transitory storage medium of claim 10, wherein the reveal condition is a number of times that the at least one user operation is to be performed.

16. The non-transitory storage medium of claim 10, wherein a number of user operations for the reveal condition is proportional to the degree of rarity of the at least one virtual content item associated with obtained result.

17. The non-transitory storage medium of claim 10, wherein the user operation is a touch operation, and wherein the reveal condition varies an amount regarding the touch operation as a function of the obtained result.

18. A method that performed on a computer system, the method comprising:

obtaining, by using a hardware processor of the computer system, a result from a process that selects, from among a plurality of virtual content items, at least one virtual content item to be provided to a user, where each of the plurality of virtual content items are associated with a degree of rarity;

setting, by using a hardware processor of the computer system, a reveal condition for the obtained result, the reveal condition differing based on the degree of rarity of the at least one virtual item that is associated with the obtained result, wherein different reveal conditions correspond to different user operation amounts;

processing at least one user operation that is provided, via an input device that is coupled to the processing system, in connection with revealing the obtained results; and output, to a display device, the obtained result based on determination that the processed at least one user operation satisfies the reveal condition for the obtained result.

19. A non-transitory storage medium having stored therein an information processing program for execution by a computer system, the information processing program comprising instruction that, when executed by the computer system, cause the computer system to:

acquire, by using the computer, a result of a selection process for, based on a certain probability, selecting at least one virtual content to be revealed to a user from among a plurality of virtual contents;

acquire, via a user input device that is coupled to the computer system, a user operation performed by a user;

generate, by using the computer, a determination condition regarding the user operation so that the determination condition differs in accordance with the result;

after the selection process and before the result is output for display, display a player object performing an action based on the user operation performed by the user; and output, to a display device that is coupled to the computer system, the result in accordance with determination that the user operation satisfies the determination condition.

20. The non-transitory storage medium of claim 19, wherein:

the action is performed on another object, and the other object is changed as a result of the player object performing the action on the other object.

* * * * *